United States Patent [19]

Planteline et al.

[11] 4,391,251

[45] Jul. 5, 1983

[54] ELECTRONIC CONTROLLER FOR CONTROLLING THE AIR/FUEL RATIO OF THE MIXTURE SUPPLIED TO AN INTERNAL COMBUSTION ENGINE

[75] Inventors: Pierre Planteline; Roger Machetel, both of Paris, France

[73] Assignee: Groupement d'Interet Economique de Recherche et de Developpement PSA, Paris, France

[21] Appl. No.: 197,604

[22] Filed: Oct. 16, 1980

[30] Foreign Application Priority Data

Oct. 19, 1979 [FR] France ..... 79 26045

[51] Int. Cl.[3] ..... F02B 3/00

[52] U.S. Cl. ..... 123/440; 123/472

[58] Field of Search ..... 123/440, 481

[56] References Cited

U.S. PATENT DOCUMENTS 3,895,611 7/1975 Endo et al. ..... 123/32 EA 4,122,811 10/1978 Bowler et al. ..... 123/119 EC 4,231,334 11/1980 Peter ..... 123/440

4,279,230 7/1981 Bauer ..... 123/440

4,307,694 12/1981 Jacobs ..... 123/440

*Primary Examiner*—Ronald B. Cox

*Attorney, Agent, or Firm*—Oblon, Fisher, Spivak, McClelland & Maier

[57] ABSTRACT

A digital electronic controller for an engine equipped with an oxygen detector located along the exhaust path of the gases and a carburettor equipped with electrovalves for regulating the fuel flow rate.

This controller comprises digital circuits for closed loop and open loop regulation including a digital memory in which the carburettor regulation value is permanently stored, a logic circuit for controlling the operating modes and a plurality of amplifiers for controlling the electrovalves of the carburettor.

This controller makes it possible to reduce the pollution level of motor vehicles.

10 Claims, 35 Drawing Figures

FIG.1
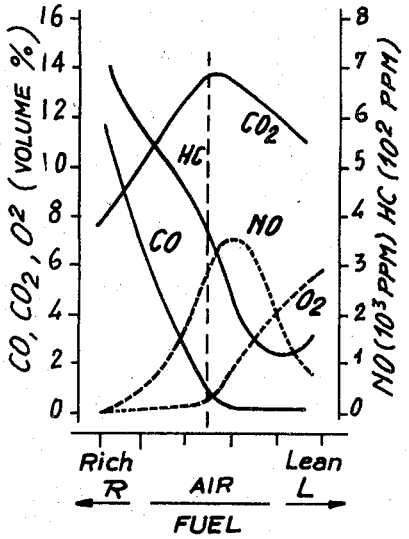
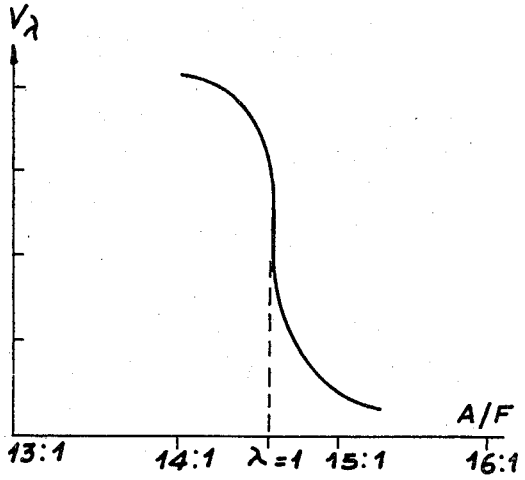
FIG.3b
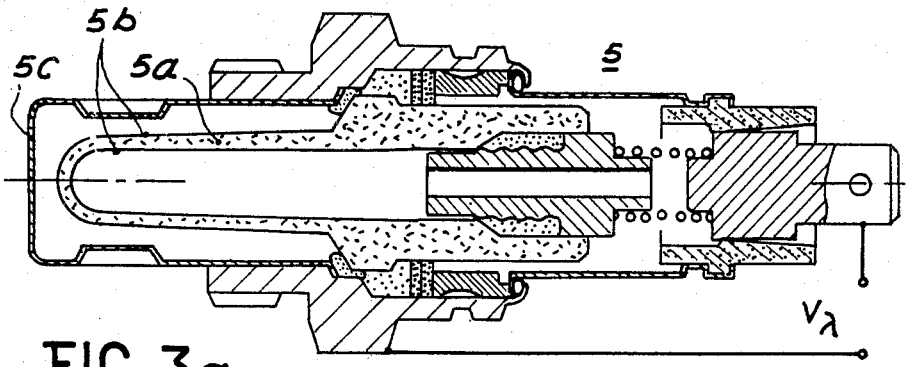
FIG.3a

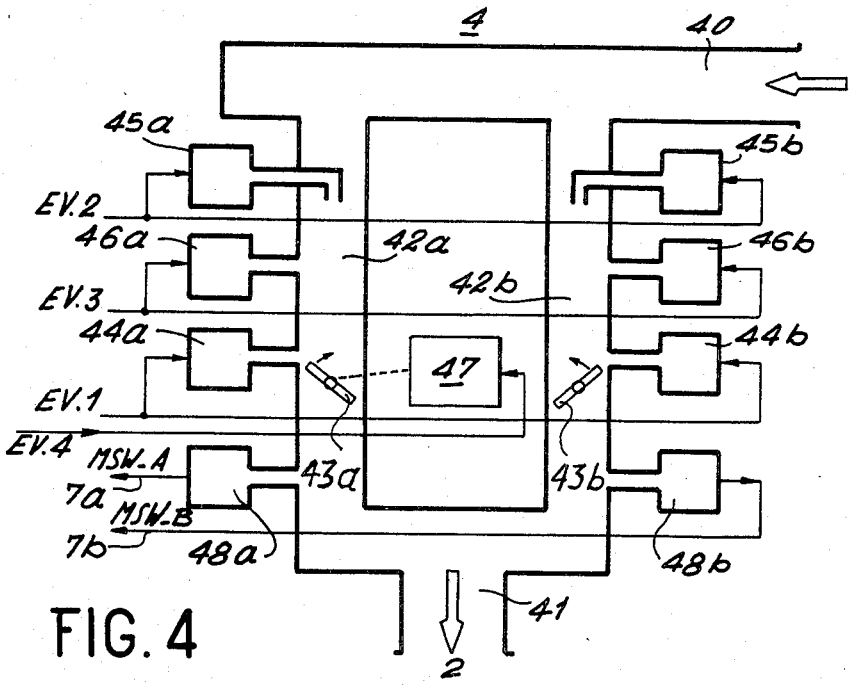
FIG. 4
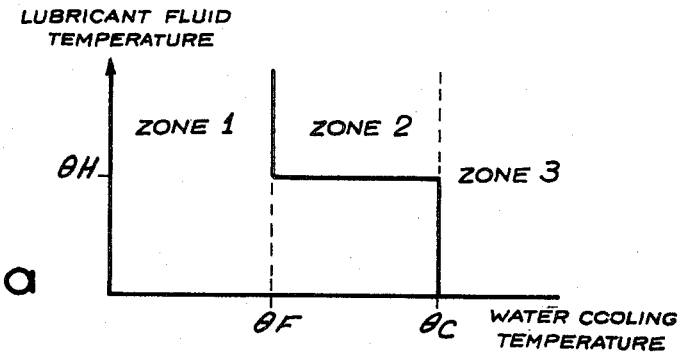
FIG. 5a
| MSW-B \ MSW-A | 0 | 1 |
|---|---|---|
| 0 | ZONE D | ZONE C |
| 1 | ZONE A | ZONE B |
FIG. 5b

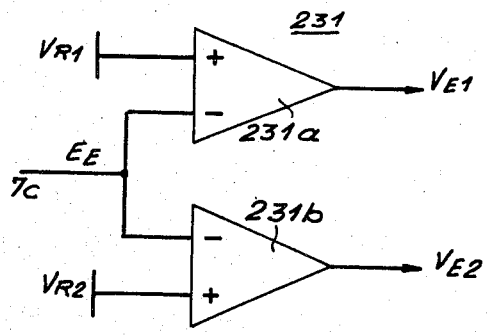
FIG.11
FIG.12a
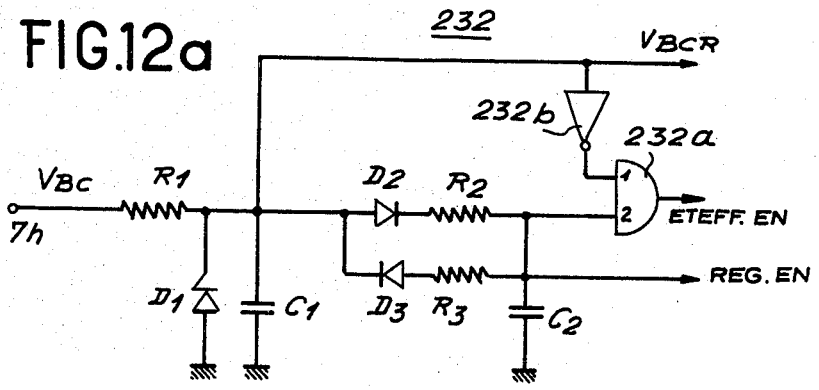
FIG.12b
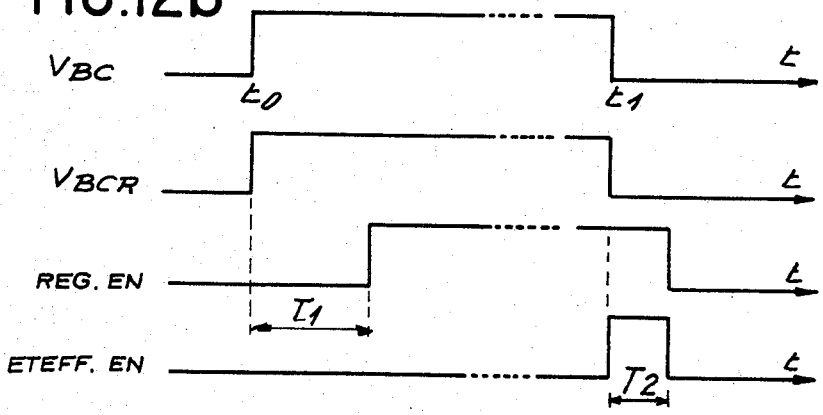

| A | B | W | Z |
|---|---|---|---|
| 0 | 0 | R(θ) | R(θ) |
| 0 | 1 | R(λ) | R(λ) |
| 1 | 0 | R(θ) | R(λ) |
| 1 | 1 | R(V) | R(V) |

16
161
162
163
164
B3
C
COUNTER
COUNTER
CK
CK
A0
A0
An-1
Am-1
CO
CO
R1(λ)
R2(λ)
R(λ)
Hc2
H0
Hi
cλ cλ
0
2^n-1
M(λ)
RCO
1
R1(λ)
R2(λ)
0
t
t
t

ELECTRONIC CONTROLLER FOR CONTROLLING THE AIR/FUEL RATIO OF THE MIXTURE SUPPLIED TO AN INTERNAL COMBUSTION ENGINE

BACKGROUND OF THE INVENTION

The invention relates to systems for supplying fuel to internal combustion engines. It specifically relates to an electronic controller for controlling the air/fuel ratio of the mixture entering the cylinders of the engine and in particular such a controller which uses the output signal from an exhaust gas oxygen (EGO) sensor positioned on the exhaust path of the burned gases.

As a result of the ever increasing number of automobiles, there is a corresponding increase to the atmospheric pollution in cities and major highways, with the resulting risks for the population living in such a noxious environment.

FIG. 1 shows the relative proportions of the main constituents of burned gases on leaving an internal combustion engine as a function of the (A/F) air/fuel ratio of the carburetted or vaporized mixture which enters the engine cylinders. The constituents which are particularly pollutant are hydrocarbon, carbon monoxide and nitrogen oxides.

It is apparent from FIG. 1 that the pollution level of an engine is reduced when the latter is supplied with a lean mixture, i.e. whose air/fuel ratio exceeds 15:1 corresponding to the stoichiometric ratio indicated from the vertical broken line. It is known that carbon monoxide emission decreases when the air/fuel ratio increases as a result of the oxygen excess which ensures a more satisfactory combustion of the carburetted mixture. In practice, due to the imperfect air/fuel mixture and the short combustion period an air excess above the air/fuel stoichiometric ratio is found to be necessary. However, an air/fuel ratio above 18:1 constitutes an upper limit because, for various reasons, hydrocarbon emission increases again, ignition of the mixture becomes critical, the power supplied by the motor is reduced and the specific consumption increases, Thus, in order to comply with existing pollution standards and in particular those which are being prepared for future use it is necessary to take supplementary measures which generally consist of burning the residual noxious agents outside the engine in catalytic or noncatalytic reactors. It is apparent from what has been stated hereinbefore that to reduce the pollution level of motor vehicles to low values, the air/fuel ratio of the carburetted mixture which enters the engine cylinders must remain within narrow limits corresponding to a lean mixture and that to obtain pleasant and flexible driving conditions it is necessary to increase the richness of the carburetted mixture for certain engine running conditions.

In a conventional carburettion or vaporization system, it is not possible to control the air/fuel ratio of the carburetted mixture with the necessary precision, in view of manufacturing variations, the inevitable wear and variations to the operating conditions, particularly the engine temperature, ambient pressure, etc. Thus, electronic carburettion controllers have already been proposed which use the electrical output signal of an EGO sensor placed along the path of the engine exhaust gases to act on the fuel flow rate supplied to the carburettor. To obtain low carbon monoxide and hydrocarbon emissions, it is necessary to operate with air/fuel ratio values of approximately 16:1 to 18:1 which also correspond to a low specific consumption, but do not make it possible to obtain the maximum power from the engine and ensure adequate ignition of the mixture when the engine temperature is low.

A lean carburetted mixture is satisfactory when the engine temperature is then firmly established, and when the average speed of revolution and load of the engine are not too high. However, a rich mixture is necessary during the starting-up period of the engine, whilst operating at high load and when acceleration is needed. The known electronic carburettion controllers operate on a closed loop principle when the engine temperature is sufficiently high and with an average load. They change over to an open loop operating principle when acceleration is necessary or in the case of high loads, so as to operate like a conventional carburettion system. However, such a solution is far from being satisfactory because immediately the automatic correction provided by the closed loop controller is lost.

With a view to obviating this deficiency of carburettor controllers, it was proposed in French Patent Application 77.39842 to use a controller incorporating memory storage means making it possible to store the closed loop carburettor control value and then control the carburettor on the open loop principle on the basis of this stored value, increased by a quantity constituting a function of the engine temperature.

BRIEF SUMMARY OF THE INVENTION

The object of the invention is a digital electronic controller for controlling air/fuel ratio of the mixture entering the cylinders of an internal combustion engine, the latter being equipped with an exhaust gas oxygene sensor positionned in the exhaust path of the burned gases, temperature, load and revolution speed sensors and at least one fuel supply device, whose flow rate can be regulated by an electrovalve controlled on the basis of an opening/closing cycle, said controller incorporating closed loop regulating circuits and open loop regulating circuits, the operating modes of these regulating circuits being governed by the operating conditions of the engine.

According to the invention, the closed loop regulating circuits comprise, connected in series, a numerical or digital integrator comprising a re-initialization means and a first digital time duration modulator of the opening/closing cycle of the electrovalve, the open loop regulating circuits comprise a digital memory provided with means for filtering and recording the content of the digital integrator and a second time duration modulator of the opening/closing cycle of the electrovalve, said second modulator having means for regulating the sensitivity as a function of an engine operating parameter such as the temperature thereof and an output connected to the input of the re-initialization means of the digital integrator.

Another object of the invention is a digital electronic controller in which the digital integrator has means making it possible to lock the latter at the extreme limits.

Another object of the invention is a digital electronic controller in which the digital integrator has means for forcing the counting directions.

Another object of the invention is a digital electronic controller incorporating a time duration modulator of the opening/closing cycle, whose sensitivity or scale factor can be multiplied as a function of the magnitude of an engine parameter, such as the temperature or speed of revolution of the engine.

BRIEF DESCRIPTION OF THE DRAWINGS

The invention is described in greater detail hereinafter relative to non-limitative embodiments and with reference to the attached drawings, wherein show:

FIG. 1 the relative proportions of the main constituents of exhaust gases, as a function of the air/fuel ratio of the carburetted mixture.

FIG. 3*a* in a sectional view a known EGO sensor or lambda detector.

FIG. 3*b* the output voltage characteristic of an EGO sensor as shown in FIG. 3*a*.

FIG. 4 in the form of a simplified diagram, a compound carburettor.

FIG. 5*a* in the form of a diagram, the different operating temperature zones of the engine.

FIG. 5*b* in the form of a table, the different operating load zones of the engine.

FIG. 12*a* in the form of an electrical diagram an embodiment of the circuit for processing the output signals $V_{BC}$ of the engine ignition key.

FIG. 12*b* chronograms of the main signals associated with the processing circuit of FIG. 12*a*.

DETAILED DESCRIPTION OF THE PREFERRED EMBODIMENTS

The controller, which will be described in greater detail hereinafter belongs to the class of servomechanisms of the proportional-integral type with a variable delay, the latter resulting from the time delay between the time at which the carburetted mixture is admitted and the time at which the burned mixture exhausts, said delay being inversely proportional to the speed of revolution of the engine.

Figure 2:
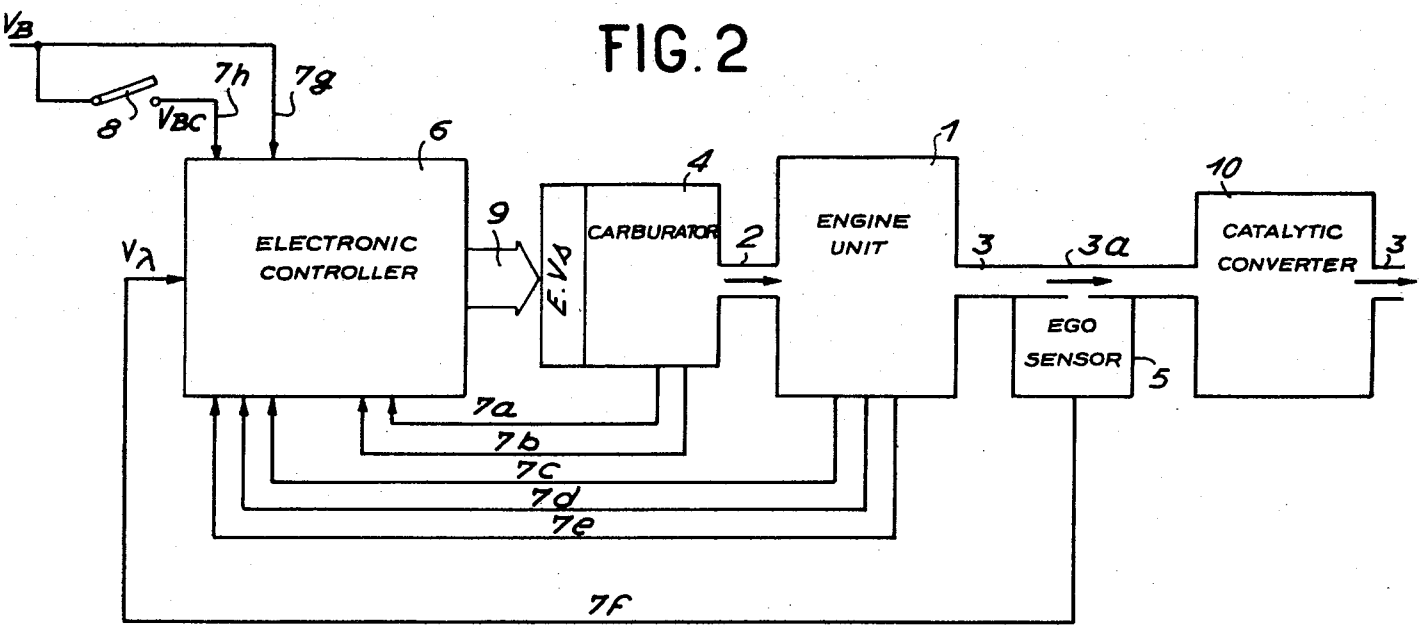
FIG. 2 in the form of a block diagram, a carburettion system for an internal combustion engine equipped with an electronically controlled carburettor.

FIG. 2 shows in the form of a block diagram a carburettion system for an internal combustion engine fitted with an electronically controlled carburettor and which comprises:

An engine unit 1 comprising an admission manifold 2 for the caburetted mixture, the exhaust manifold 3 for the burned gases and generally cooling water and lubricating oil temperature sensors, which are not shown in the drawing.

A carburettor 4 equipped with its accessories such as the air filter, the fuel supply pump, etc. This carburettor, which can be of a known type has electromechanical means E.Vs making it possible to vary the flow rate of the fluids. For example, these electromechanical means can be constituted by electrovalves, advantageously operating on an "ON/OFF" basis. It can also have pressure sensors making it possible to obtain information on the vacuum magnitudes in the inlet manifold and which represent the engine load.

An EGO sensor 5, commonly called a lambda sensor which is positioned directly on the exhaust pipe 3*a* leaving the exhaust manifold 3. It supplies an output signal Vλ which represents the air/fuel ratio of the carburetted mixture.

An electronic controller 6, which can operate on various operating modes, particularly a closed loop regulating mode, an open loop control mode and optionally a hybrid regulator/control mode, said operating modes being governed by the operating conditions of the engine. The controller receives on the one hand on connection 7*f* the input signal Vλ supplied by the EGO sensor 5, the signal supplied by the different sensors of the engine, e.g. on connections 7*a* and 7*b* signals supplied by the pressure sensors, on connection 7*c* a signal supplied by the cooling water temperature sensor, on connection 7*d* a signal supplied by the lubricating oil temperature sensor, on connection 7*e* a signal representative of the speed of revolution of the engine and also from the electric power source or supply of the vehicles directly on connection or line 7*g* a voltage $V_B$ and indirectly on line 7*h* across a switch 8 or the ignition key a voltage $V_{BC}$. On line 9, the controller supplies electrical control signals with respect to electrovalves $EV_s$.

One or more catalytic or non-catalytic converters 10 arranged in series with the exhaust pipe 3*a* and whose function is to complete the action of the controller in order to reduce emission levels of noxious agents to the extremely low values laid down by the anti-pollution standards in question.

FIG. 3*a* is a sectional view of a known EGO sensor, which comprises a zirconium dioxide active element 5*a*, whose inner and outer faces 5*b* are covered with a platinum film. This active element is protected from the direct abrasion of exhaust gases by an outer cover 5*c* provided with openings permitting the exhaust gases to reach the sensitive part. When the active element is heated to an adequate temperature, the zirconium dioxide and platinum act like an electrochemical cell. The internal impedance, output voltage Vλ and response time of this cell are a function of the temperature.

FIG. 3*b* shows the characteristic of the output voltage Vλ with respect to the air/fuel ratio of the mixture. A very low level signal Vλ is generally generated when the air/fuel ratio is lean, i.e. below the stoichiometric value. When the air/fuel ratio is rich, the signal Vλ reaches a value of approximately 1 Volt and it is this abrupt characteristic which is utilized for maintaining, in closed loop, the air/fuel ratio value close to the stoichiometric value. With this type of sensor it is necessary to provide timing means on starting the vehicle when the sensor has not reached its operating temperature.

FIG. 4 shows in the form of a simplified diagram a compound carburettor 4 having an air inlet 40 and a carburetted mixture outlet 41 between which there are two carburettion chambers, namely a first chamber 42*a* and a second chamber 42*b* within which are respectively placed the throttles 43*a* and 43*b* mechanically coupled in such a way that on pressing on the accelerator pedal throttle 43*b* only opens when throttle 43*a* is almost completely open. Thus, at the start of the travel of the accelerator pedal, only the first carburettion chamber operates, then the second chamber progressively comes into operation jointly with the first chamber.

The carburettion chambers are supplied with fuel via the different spray nozzles, whose flow rates are controlled by the following electrovalves: electrovalves EV1 of the idling nozzles 44*a* and 44*b*, electrovalves EV2 of the main nozzles 45*a* and 45*b* and electrovalves EV3 for the richness increasing means 46*a*, 46*b*. Moreover, an electrovalve EV4 makes it possible to operate the opening means 47 of throttle 43*a* located in the first carburettion chamber. Finally, two vacuum sensors 47*a*, 47*b*, constituted by microswitches MSW-A and MSW-B indicate the engine load conditions.

An electrovalve is constituted by an electromagnetic valve member controlled by an electric signal. Generally, electrovalves of the "ON/OFF" type are used, the "ON" state corresponding to the absence of an electric current passing through them. In order to control the fluid flow rate in a continuous manner, such electrovalves must be controlled on the basis of periodic square-wave signals by their cyclic ON/OFF ratio, i.e. this is specifically the case with electrovalves EV1 and EV2 associated with the spray nozzles, whilst electrovalves EV3 and EV4 can be controlled by continuous signals. Due to the fact that the absence of current passing through an electrovalve corresponds to a maximum fluid flow rate, it may prove necessary for the purpose of eliminating the self-ignition phenomenon to provide specific means making it possible to keep the electrovalve in the closed position for a few seconds after opening contact 8. This applies to electrovalves EV1, EV2 and EV3. To this end, controller 6 processes a quenching signal as soon as the ignition key has been switched off to the stop position.

Engine Temperature Zones

The engine temperatures are defined both by the lubrificating oil and the cooling water temperatures.

The oil temperature can be given by a thermal switch biased to a temperature $\theta_H$, which supplies a high level electric signal $E_H$ when the oil temperature exceeds the value $\theta_H$ and a low level signal when the oil temperature is below the value $\theta_H$, said electric signal $E_H$ being available on line 7*d*.

The cooling water temperature can be given by a temperature sensor supplying an electric signal $E_E$ which is representative of the water temperature. This electric signal is available on line 7*c*. Three temperature ranges for the water are under consideration:

(a) very cold: below a value $\theta_F$ (b) cold: between the value $\theta_F$ and a higher value $\theta_C$ (c) warm above value $\theta_C$.

Whilst considering the oil and water temperatures, it is possible to define three engine temperature zones illustrated in FIG. 5*a*:

Zone 1: $\overline{\theta}_F$ or $(\theta_F.\overline{\theta}_C.\overline{\theta}_H)$ Zone 2: $\theta_F.\overline{\theta}_C.\theta_H$ Zone 3: $\theta_C$ When the engine temperature is in zone 1, the controller always operates in open loop. When the engine temperature is in zone 3, the controller is enabled to operate in closed loop.

Engine Load Zones

The engine load is indicated by the state of microswitches MSW-A and MSW-B, respectively associated with the first and second carburettion chambers. Thus, on the basis of the states of these two microswitches, it is possible to define four engine load zones (illustrated in FIG. 5*b*):

Zone A: idling $(\overline{\text{MSW-A}}).(\text{MSW.B})$

Zone B: average $(\text{MSW.A}).(\text{MSW.B})$

Zone C: high $(\text{MSW.A}).(\overline{\text{MSW.B}})$

Zone D: maximum $(\overline{\text{MSW.A}}).(\overline{\text{MSW.B}})$

Controller Structure

Figure 6:
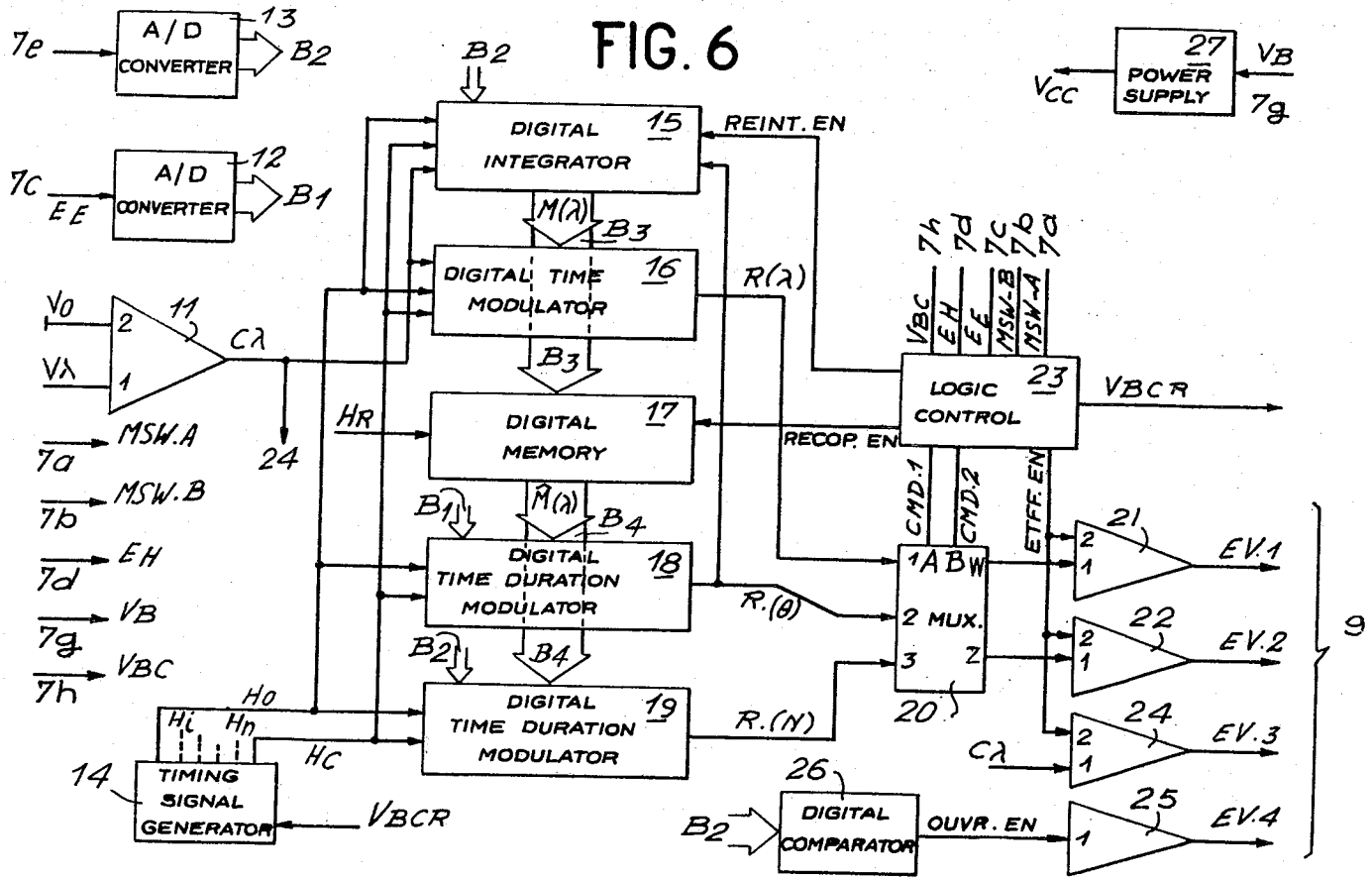
FIG. 6 in the form of a block diagram, the basic structure of an electronic carburettion controller according to the invention.
Figure 7A:
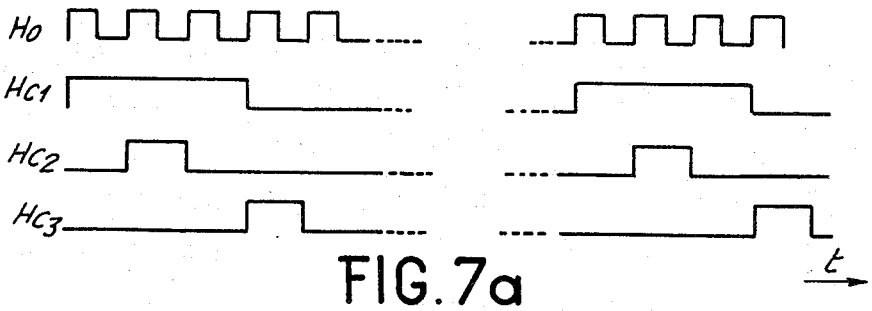
FIG. 7*a* in the form of chronograms, the wave forms of timing signals $H_o$ and $H_c$.
Figure 7B:
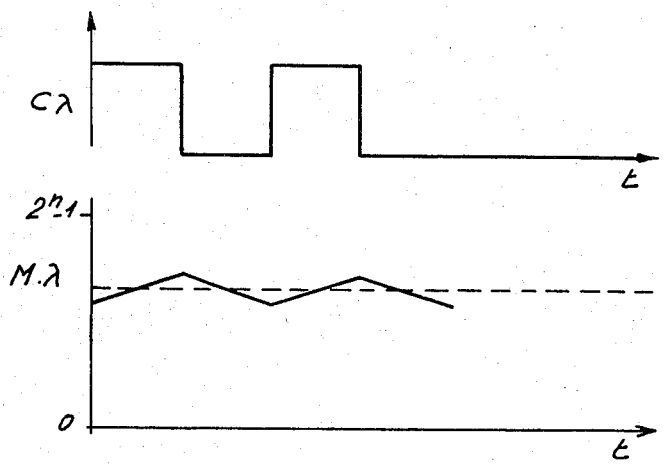
FIG. 7*b* in the form of a chronogram, the wave forms of an output signal Cλ compared with a signal M(λ).
Figure 7C:
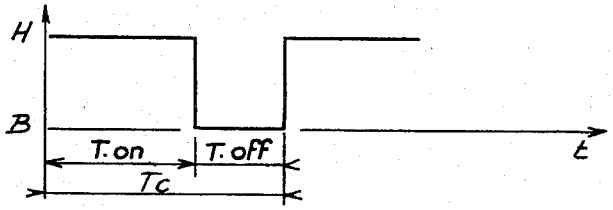
FIG. 7*c* a chronogram of the output signals R(λ) or R(θ) or R(N) of the time duration modulators.
Figure 7D:
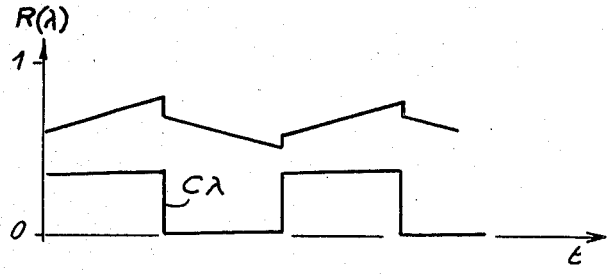
FIG. 7*d* a chronogram of the cyclic opening ratio value of the output signal R(λ) compared with the output signal Cλ of the level comparator.
Figure 8A:
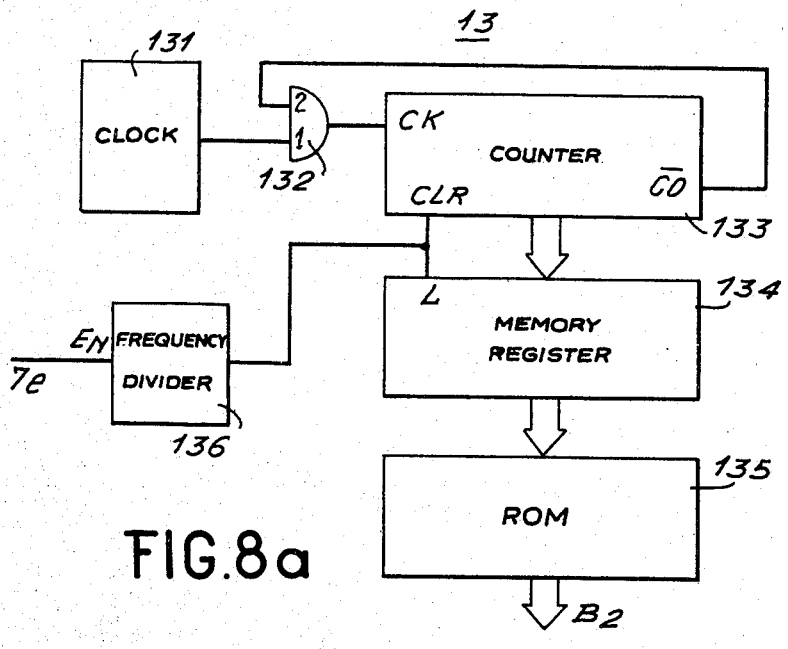
FIG. 8*a* in the form of a block diagram, a constructional embodiment of the analog/digital converter supplying a digital signal representing the speed of revolution of the engine.
Figure 8B:
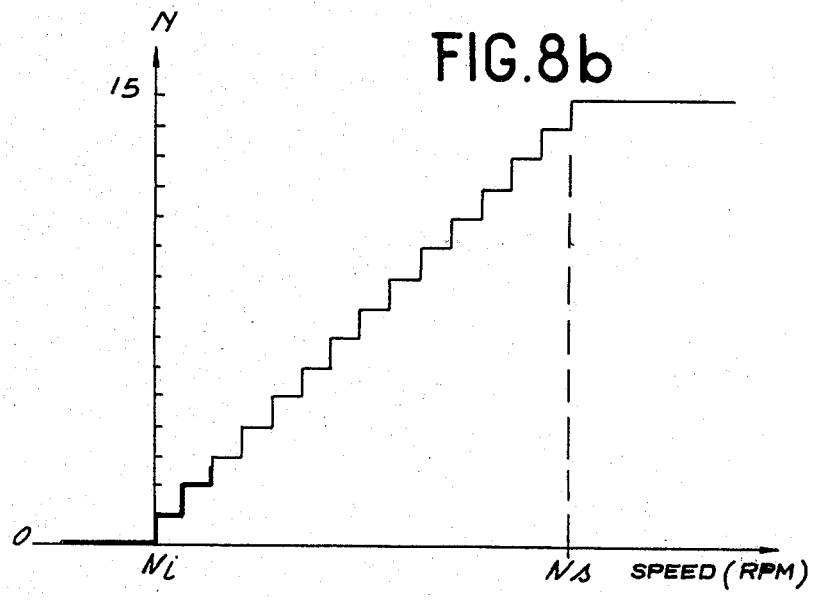
FIG. 8*b* shows the conversion characteristics of the A/D converter of FIG. 8*a*.

FIG. 6 shows in the form of a block diagram the basic structure of the electronic carburettion controller 6.

Hereinafter, it is assumed that this controller functions on the basis of a lambda sensor as described in FIG. 3*a* and is associated with a carburettor of the type illustrated in FIG. 4. This controller comprises the following members:

A voltage comparator 11, advantageously of the hysteresis type which has a first input receiving the output signal Vλ supplied by EGO sensor 5 located on the exhaust path of the burned gases and a second input connected to a fixed d.c. voltage source $V_o$. This comparator supplies an output signal Cλ having two states, namely a high level state when the air/fuel ratio is lean and a low level state when the air/fuel ratio is rich.

A first analog/digital converter 12, the converter input receiving by connection *7c* a continuous electric signal $E_E$ representative of the engine cooling water temperature $\theta$. Converter 12 supplies on a bus line B1 digital data representing the engine water temperature.

A second analog/digital converter 13, whose input receives a pulse-type signal $E_N$, whose repetition frequency is proportional to the speed of revolution N of the engine. This converter supplies on a bus line B2 digital data representing the speed of revolution N of the engine.

A timing signal generator 14 which incorporates a pilot clock, frequency dividing circuits and means for interrupting the pilot clock. This generator supplies two basic timing signals, namely a timing signal Ho of frequency Fo and a timing signal Hc of frequency Fc corresponding to the cycle frequency of electrovalves EV1 and EV2 and timing signals $H_i$ to $H_n$ at the frequency intermediate between the extreme frequencies Fo to Fc.

A digital integrator 15, which incorporates a programmable counter of the up/down type increased by a timing signal Ho, counting direction control means connected to the output of comparator 11 and the initialization means. There are also means making it possible to modify the integral loop gain as a function of the speed of revolution of the engine, said means being controlled by the digital signal available on bus B2.

A first time duration modulator 16 connected to bus B3, said modulator incorporating two programmable counters of the down type and means making it possible to introduce the proportional gain term. This modulator processes a square-wave output signal R(λ) of the repetition frequency $F_c$ making it possible to control the cyclic opening ratio of electrovalves EV1 and EV2 in closed loop. It receives timing signals $H_o$ and $H_c$.

A digital memory 17 connected to bus B3, said memory processing and storing digital data $\hat{M}(\lambda)$ corresponding to the filtered version of the digital data $\hat{M}(\lambda)$. This operation of recording the content of the digital integrator 15 is only actived when the carburettion system operates on a closed loop basis and when the engine operates with an average load. For this purpose, the digital memory receives a RECOP.EN signal enabling the recording operation. The digital memory has means for initialization to a given value, the recording rate being fixed by the frequency of a timing signal $H_R$. The digital output data $\hat{M}(\lambda)$ is transmitted on a bus B4.

A second time duration modulator 18 connected to bus B4, which includes a programmable counter of the down type and means implicitly making it possible to multiply the digital data $\hat{M}(\lambda)$ by a factor which is a function of the cooling water temperature $\theta$ of the engine. This modulator processes a square-wave output signal $R(\theta)$ of the repetition frequency $F_C$ making it possible to control the cyclic opening ratio of electrovalves EV1 and EV2 in closed loop. It receives the timing signals $H_c$ and $H_i$ and via bus B1 the digital data corresponding to the engine cooling water temperature. The output signal $R(\theta)$ is also used for the re-initialization of digital integrator 15.

A third time duration modulator 19 connected to bus B4 which includes a programmable counter of the down type and means making it implicitly possible to multiply the digital data $\hat{M}(\lambda)$ by a factor which is a function of the speed of revolution N of the engine. This modulator processes a square-wave output signal R(N) of repetition frequency $F_c$ making it possible to control the cyclic ON/OFF of electrovalves EV1 and EV2 in open loop and when the engine load is at a maximum.

A multiplexer 20 having three inputs respectively connected to the time duration modulators 16, 18 and 19. It has two control inputs A and B and two outputs W and Z respectively connected to the control amplifiers 21 and 22 of electrovalves EV1 and EV2.

A first electrovalve control amplifier 21 of the "ON/-OFF type" comprising a first input connected to the output W of multiplexer 20 and a second input which receives the ETFF.EN signal permitting the quenching of the engine on opening the ignition key 8.

A second electrovalve control amplifier 22, which is identical to the first and a first input connected to output Z of multiplexer 20 and a second input which receives the ETFF.EN signal.

A third electrovalve control amplifier 24 which, identical to the first, has a first input connected to the output of elevel comparator 11 and a second input which receives the ETFF.EN signal. The output of this amplifier is connected to the richness-increasing electrovalve EV3.

A fourth electrovalve control amplifier 25, identical to the other amplifiers and comprising a first input connected across a digital comparator 26 to the connecting bus B2 to analog/digital converter 13, which supplies the speed of revolution N of the engine in the form of a digital signal.

A logic control circuit 23 of the operating modes of circuits included in the controller. The inputs of this logic circuit are connected to the aforementioned lines or connections *7a, 7b, 7c, 7d, 7e* and *7h*. This circuit supplies the following signals: signals CMD.1 and CMD.2 for controlling multiplexer 20, signal ETFF-.EN, a REINT.EN signal enabling the reinitialization of digital integrator 15, a RECOP.EN signal enabling the recording of digital memory 17 and a signal $V_{BCR}$ making it possible to interrupt the timing signals and prevent the passage of a current in the different electrovalves a short time after switching off ignition key 8.

A regulated power supply 27 of the Zener diode type permanently connected to the electric power supply $V_B$ of the vehicle and which supplies a regulated d.c. voltage $V_{cc}$.

This controller can be designed on the basis of digital circuits, which are advantageously produced by complementary metal-oxide-semiconductor (C.MOS) technology. Thus, the controller can be kept permanently live, provided that the pilot clock of the timing signal generator 14 is interrupted and the passage of a current is prevented in the electrovalve control amplifiers during periods when the engine is non operating. It is possible to use for this purpose data supplied by the output signal $V_{BC}$ of the engine ignition key 8.

FIG. *7a* shows in the form of chronograms the wave forms of timing signals $H_o$ and $H_c$ supplied by the timing signal generator 14. Thus, timing signal $H_c$ of frequency $F_c$ is available in three forms: a timing signal $H_{c1}$ whose time duration is equal to three "cycles" of clock $H_o$ and intended more particularly for stabilising the internal data of the controller, a timing signal $H_{c2}$ positioned within the signal $H_{c1}$ and intended more particularly for transferring, sampling and storing certain internal data and a timing signal $H_{c3}$ positioned externally of timing signal $H_{c1}$ intended more particularly for the zeroing or resetting of the content of certain counters. The value of frequency $F_c$ of the timing signal $H_c$ can be approximately 10 Hz. The value of the frequency $F_o$ of timing signal $H_o$ is equal to $2^n.F_c$ in which the exponent n determines the precision or resolution of the closed loop controller. This generator 14 is able to supply different timing signals $H_i$ to $H_n$ at frequencies intermediate between the extreme values $F_o$ and $F_c$.

FIG. *7b* shows in the form of chronograms, the wave form of output signals Cλ of level comparator 11 compared with the output signal M(λ) of the digital integrator 15. The wave form of signal Cλ is idealised in the sense that it constitutes an error signal and that then the period or cycle of the square waves is of a random nature. The high level state of signal Cλ corresponds to a lean carburetted mixture, i.e. to a richness-increasing command. Signal M(λ) fluctuates around an average value indicated by a broken line, a positive slope corresponds to an enrichment of the carburetted mixture, whilst a negative slope corresponds to the making of said mixture leaner. The numerical value of signal M(λ) can be between the extreme value 0 and $2^n-1$.

FIG. *7c* shows in the form of a chronogram the wave form of the output signals R(λ), R(θ) and R(N) of the time duration modulators 16, 18 and 19. The period of these signals is $T_c=1/F_c$ and are at high level for a time $T_{on}$ corresponding to the opening period of the valve members of the electrovalve and at low level B for a time $T_{off}$ corresponding to the closing time of the valve members of the electrovalves. The cyclic opening ratio of the electrovalves is given by the relationship $$RCO=T_{on}/T_c$$

FIG. *7d* shows in the form of a chronogram, the cyclic opening ratio value of output signal R(λ) of time modulator 15 compared with the output signal $C_\lambda$ of level comparator 11.

CONVERTER 13

FIG. *8a* shows in the form of block diagram an embodiment of analog/digital converter 13 shown in FIG. 6. This converter makes it possible to convert the engine revolution speed data available in the form of a frequency into digital data adapted to the controller. The engine revolution speed data can be supplied by the electric signal of the ignition coil or any other equivalent known means. This converter must supply a digital output data between a lower revolution speed $N_i$ and a higher revolution speed $N_s$. To this end, it comprises the following elements connected in series:

means for measuring the engine revolution period incorporating a clock circuit 131 and an AND logic gate 2 connected to the clock input CK of an uptype digital counter 133 and which are connected in series, a memory register 134 for storing the content of the aforementioned digital counter, a read-only memory (ROM) 135.

Input signal $E_N$ available on connection *7e*, optionally via a frequency dividing circuit 136, cyclically loads the content of counter 133 into register 134 which has a loading input L and resets at value 0 the content of the said counter which has a clearing input CLR. The overflow output $\overline{Co}$ of counter 133 is connected to a second input of gate 132.

FIG. *8b* shows in exemplified manner the conversion characteristic of analog/digital converter 13. The digital output data is available on four bits, e.g. on bus B2 below a lower revolution speed $N_i$ and above an upper revolution speed $N_s$. This data is constant. In the revolution speed range between values $N_i$ and $N_s$, said digital output data varies in linear manner in stages.

LOGIC CONTROL CIRCUIT 23

Figure 9:
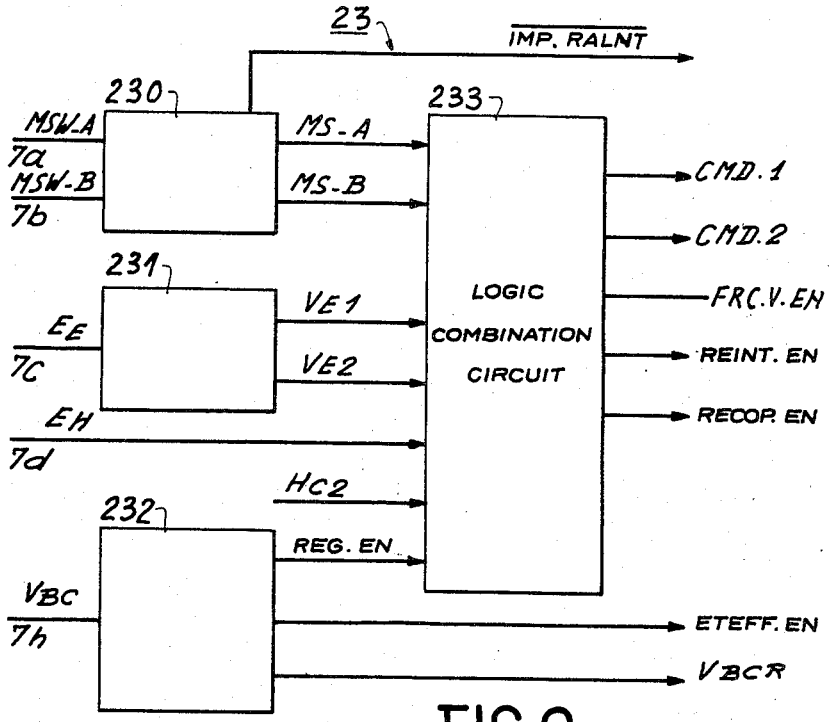
FIG. 9 in the form of a block diagram, an embodiment of the logic control circuit of the operating modes of the controller.

FIG. 9 shows in the form of a block diagram an embodiment of the logic control circuit relative to the operating modes of the circuits to be controlled. This control circuit comprises the following elements:

A circuit 230 for processing the electric signal supplied by microswitches MSW-A and MSW-B. This circuit processes a pulsed signal IMP.RALNT indicating that the motor is leaving zone A corresponding to idling conditions, a signal MS-A corresponding to the signal MSW.A sampled by timing signal $H_{c2}$ and a signal M.S-B corresponding to signal MSW-B sampled by the timing signal $H_{e2}$.

A circuit 231 which processes two electric signals representing the cooling water temperature range of the engine. They consist of a first signal $V_{e1}$ corresponding to a temperature range below or above the already defined value $\theta_F$ and a signal $V_{E2}$ corresponding to a temperature range above or below a value $\theta_c$ defined hereinbefore.

A circuit 32 for processing the output signal $V_{Bc}$ of the engine ignition key 8 and which is connected to line *7h* carrying the data $V_{Bc}$ corresponding to voltage $V_B$ from the vehicle power supply after passing through the ignition key 8. This circuit processes three electric signals, namely a REG.EN signal enabling the controller to operate in closed loop, a second ETFF.EN signal making it possible to force electrovalves EV1, EV2 and EV3 to close for a few seconds after operating the ignition key 8 and a third signal $V_{BCR}$ corresponding to the level-regulated signal $V_{BC}$ and which makes it possible to interrupt the different timing signals and maintain in the closed state the electrovalve control amplifiers 21, 22, 24 and 25.

A logic combination circuit 233 receiving at its inputs the following signals: MS-A, MS-B, $V_{E1}$, $V_{E2}$, $E_H$, REG.EN. This logic circuit processes the following output signals: signals CMD.1 and CMD.2 for controlling multiplexer 20, signal REINT.EN enabling the reinitialization of the content of digital integrator 15 to a value corresponding to the magnitude of signal R(θ), signal RECOP.EN enabling the recording of the digital data M(λ) by digital memory 17 and an auxiliary FRC.U.EN signal enabling the forcing of the count in the direct direction of the digital integrator 15. This logic circuit comprises output registers loaded by the timing signal $H_{c2}$.

Figure 10:
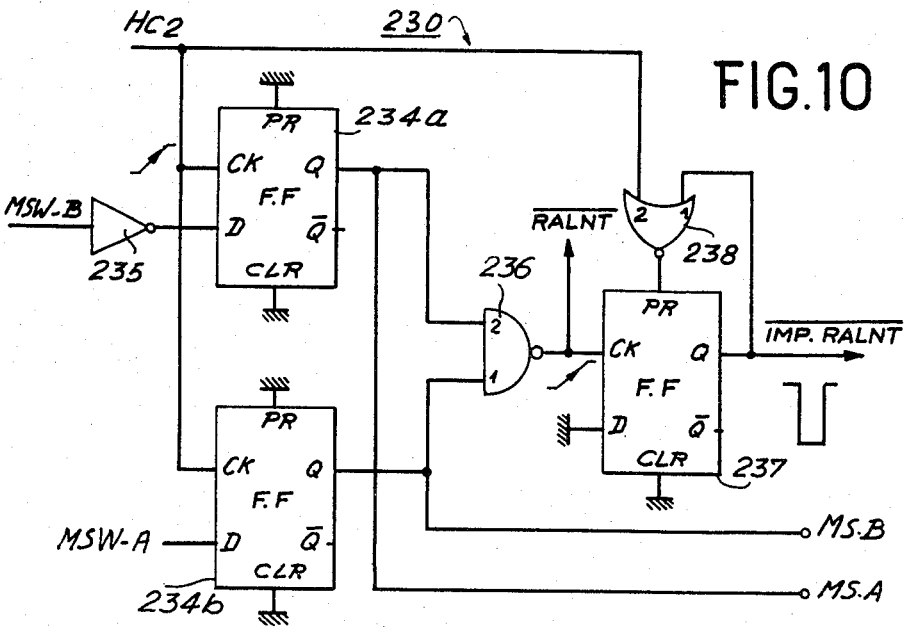
FIG. 10 in the form of a block diagram an embodiment of the circuit for processing the signals MSW-A and MSW-B FIG. 11 in the form of a block diagram an embodiment of the circuit for processing signals representing the temperature ranges of the engine water.

FIG. 10 shows in the form of a block diagram an embodiment of the circuit 230 for processing signals MSW.A and MSW.B representing the engine load. This circuit comprises the following members:

A circuit making it possible to process a $\overline{\text{RALNT}}$ signal indicating that the engine is functioning under idling conditions and which includes flip-flops 234a and 234b of the D type, an inverter 235 connected to input D of flip-flop 234a and a logic NAND gate 236, the inputs of said gate being connected to the outputs Q of the flip-flops.

A circuit making it possible to detect the passage from the idling state to the higher load states and which includes a flip-flop 237 of the D type and a logic NOR gate 238 connected to the high level positioning input PR of flip-flop 237. Input D of flip-flop 237 is placed at low level and input CK is connected to gate 236. Output Q is connected to a first input of gate 238.

At the start of each operating signal of the electrovalve, the leading front of the timing signal $H_{c2}$ samples the state of signals MSW-A and MSW-B and the resulting sampled signals MS-A and MS-B are available respectively at the outputs Q of flip-flops 234*a* and 234*b*. Signal RALNT is at low level during the idling state of the engine. When the engine leaves the idling state, the rising transition of signal $\overline{\text{RALNT}}$ samples the input D of flip-flop 237 which has the effect of setting output Q of said flip-flop at low level. By means of gate 238, the trailing front of timing signal $H_{c2}$ then resets the output Q at high level. This leads provides to a pulsed output Q at high level. During a half-cycle of the basic clock when the engine leaves the idling state.

FIG. 11 shows in the form of a block diagram circuit 231 which processes signals representative of the temperature ranges of the engine cooling water. This circuit essentially comprises two voltage comparators 231*a* and 231*b*. The first inputs of these comparators received by line 7C the signal which is representative of the water temperature, whilst the second input of comparator 231*a* is connected to a reference voltage source $V_{R1}$, whilst the second input of comparator 231*b* is connected to a reference voltage source $V_{R2}$ which differs from $V_{R1}$. Comparator 231*a* supplies a, for example, high level output signal $V_{E1}$ when the water temperature exceeds a value $\theta_F$ and comparator 23*b* supplies a, for example, high level output signal $V_{E2}$ when the water temperature exceeds a value $\theta_c$ where the value of $O_c$ exceeds the value $\theta_F$.

FIG. 12*a* shows in the form of an electric diagram, an embodiment of the processing circuit for signal $V_{BC}$. This circuit receives line 7*h* the signal $V_{BC}$ corresponding to the signal for starting the engine and also the controller. This circuit 232 comprises the following members:

a network regulating the voltage $V_{BC}$ constituted by series resistor R1 and a Zener diode D1 shunted by capacitor C1, said network supplying an output signal $V_{BCR}$, two unidirectional delay network, a first network constituted by diode D2, resistor R2 and capacitor C2 and a second network consituted by diode D3, resistor R3 and capacitor C2, a logic AND gate 232*a*, whose first input is connected via an inverter 232*b* to voltage $B_{BCR}$ and whose second input is connected to capacitor C2, said gate supplying an output signal ETFF.EN.

FIG. 12*b* shows chronograms of the main signals associated with the circuit of FIG. 12*a*. The instant of switching on the vehicle ignition key 8 corresponds to time to and the instant of switching off said key corresponds to time $t_1$. The output signal REG.EN appears with a time delay $T_1$ relative to time to corresponding to the time constant of network R2.C2. The amount of time delay $T_1$ is more particularly determined by the time taken for heating up the EGO sensor 5. Signal REG.EN enables the controller to regulate on the closed loop mode. Signal ETFF.EN appears at time $t_1$ and lasts for time duration $T_2$ fixed by the time constant R3.C3. The duration of time T2 must be sufficient, namely a few seconds, so as to prevent any self-ignition phenomenon after the stoppage of the engine. The durations of signals $V_{BC}$ and $V_{BCR}$ are identical and equal to the duration of switching on key 8.

CONTROLLER OPERATING MODES

The controller operating modes are determined by the operating temperature and load zones of the engine. These modes result from the states of the output signals processed by the logic control circuit 23.

Open Loop Mode

Start period signal REG.EN is at low level for about 20 seconds.

Engine cold and very cold: temperature zone 1.

In both cases, the electrovalves are controlled by signal $R(\theta)$ and digital memory 17 does not record the digital data $M(\lambda)$ of digital integrator 15.

Engine operating at maximum load-load zone D, signal REG.EN is at high level.

In this case, the electrovalves EV1 and EV2 are controlled by signal R (N) and digital memory 17 does not record the digital data $M(\lambda)$ of digital integrator 15.

Closed Loop Mode warm engine: temperature zones 2 and 3 Idling: engine load zone A.

The electrovalves EV1 (idling spray nozzles) are controlled by the signal $R(\lambda)$ and the electrovalves EV2 (main spray nozzles) are controlled by signal $R(\theta)$. Digital memory 17 does not record data $M(\lambda)$ of the digital integrator 15. Average load: engine load zone B.

Electrovalves EV1 and EV2 are controlled by signal $R(\lambda)$ and digital memory 17 records the digital data $(M\lambda)$ of the digital integrator 15. High load: engine load zone C.

Electrovalves EV1 and EV2 are controlled by signal R(N) and digital memory 17 does not record the digital data $M(\lambda)$ of digital integrator 15.

Auxiliary Modes

The auxiliary modes relate to the electrovalves EV3 and EV4 corresponding respectively to the enrichment means and the opening means of the carburettor.

When the carburetted mixture is lean the output signal $C\lambda$ of comparator 11 is at high level and enables the opening of electrovalves EV3 across control amplifier 24.

When the speed of revolution N of the engine exceeds a given value between the already defined limits $N_i$ and $N_s$ electrovalve EV4 actuates the opening means of throttle 43*a* located in the first chamber of the carburettor.

MULTIPLEXER 20

Figures 13A, 13B:
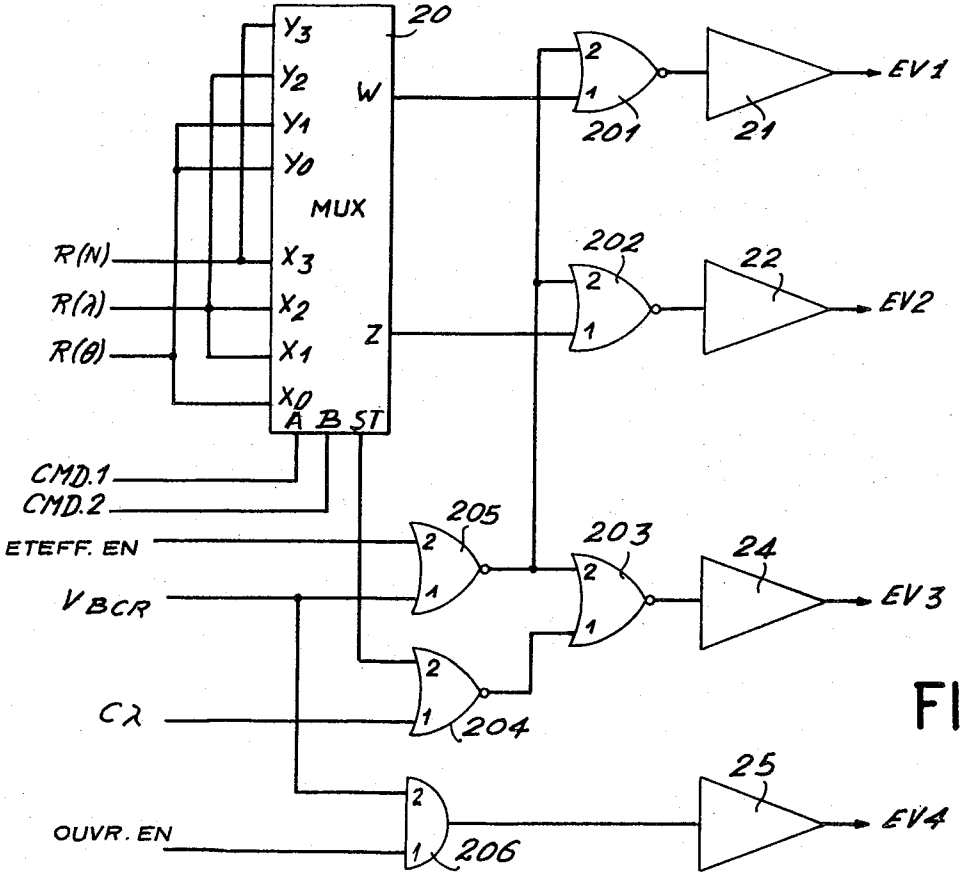
FIG. 13*a* in the form of a block diagram an embodiment of the multiplexer and the logic circuits associated with the control amplifiers of the electrovalves.
FIG. 13*b* in table form, the connection between the inputs and outputs of the multiplexer.

FIG. 13*a* shows in the form of a block diagram an embodiment of multiplexer 20 and the logic circuits associated with the control amplifiers of electrovalves 21, 22, 24 and 25. The multiplexer 20 is of the double type (4 inputs→1 output) and has two control inputs A and B which respectively receive the control signals CMD.1 and CMD.2 processed by logic circuit 23, two outputs Z and W which respectively correspond to the input groups $X_o$ to $X_3$ and $Y_o$ to $Y_3$ and finally an auxiliary control input ST which, at high level, makes it possible to force outputs Z and W to low level.

The inputs of amplifiers 21, 22 and 24 of electrovalves EV1, EV2 and EV3 are respectively connected to the outputs of the logic NOR gates 201, 202 and 203, so as to ensure the quenching function during the switch-on of ignition key 8. The first input of gate 201 is connected to output W of the multiplexer. The first input of agate 202 is connected to output Z of the multiplexer 20. The first input of gate 203 is connected to the output of a NOR gate 204. The second inputs of gates 201 to 203 are connected to the output of a NOR gate 205. The first input of gate 204 receives the output signal Cλ from level comparator 11 and the first input of gate 205 receives the signal $V_{BCR}$. The second inputs of gates 204 and 205 receive the signal ETFF.EN. The input of amplifier 25 for controlling electrovalve EV4 is connected to the output of an AND gate 206. The first input of this gate receives the control signal OVR.EN and the second input the signal $V_{BCR}$.

The connections between inputs X, Y and outputs Z, W of multiplexer 20 are given in the table shown in FIG. 13*b*. It is pointed out that when the input of amplifiers 21, 22, 23 and 24 is at low level, the current passing through the electrovalves is zero corresponding to the opening thereof. During the switch-off of ignition key 8, signal ETFF.EN is at low level and signal $V_{BCR}$ is at high level. As a result, the output of gate 205 is at low level and the output of gates 201, 202 and 203 are at the level complementary to the level of the signals present on the first inputs of these gates. When the ignition key is in the switch-on position, the signal ETFF.EN is at high level for a few seconds. As a result, the outputs Z and W of multiplexer 20 are at low level and signal $V_{BCR}$ is at low level, so that the outputs of gates 201 to 203 and 206 are at high levels, thus ensuring the closing of electrovalves EV1, EV2 and EV3 and the opening of electrovalve EV4. When signal ETFF.EN returns to low level, the output of gate 205 is at high level and the output of gates 201 to 203 is at low level, so that the electrical consumption of all the control amplifiers of the electrovalve is zero.

Figure 14:
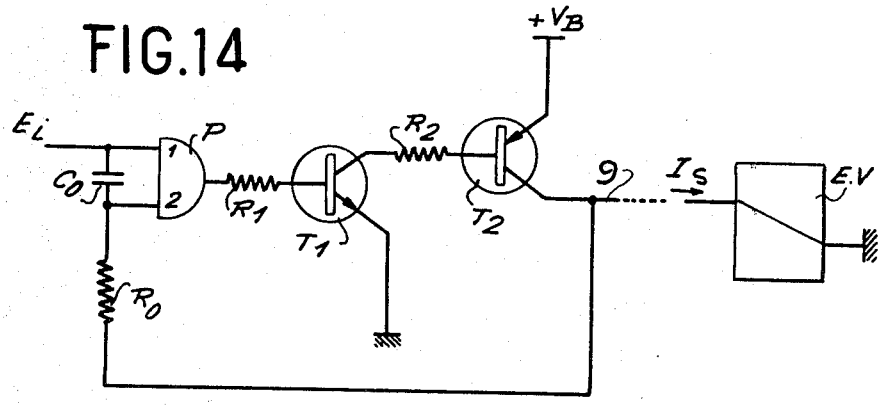
FIG. 14 in the form of a block diagram, an embodiment of an electrovalve control amplifier.

FIG. 14 shows in the form of an electric diagram an embodiment of an electrovalve control amplifier. This amplifier comprises, connected in series: a control transistor T1 and a switching transistor T2. Electrovalve EV is connected to the emitter output of transistor T2 by a cable 9. During the handling of cable 9, the latter can accidentally be short-circuited to earth, which could lead to the destruction of the amplifier. To obviate this, the amplifier has a protective means against short-circuits of connection 9, comprising a logic AND gate P, whose two inputs are shunted by a capacitor C, the first input of this gate receiving the amplifier control signal and the second input being connected, across a resistor Ro to the emitter of the switching transistor. Elements Ro and Co constitute a high pass system for input signal $E_i$.

When input signal $E_i$ is at high level, a current $I_s$ flows in electrovalve EV and the emitter of the switching transistor is at high level. During an accidental short-circuit of cable 9, the emitter voltage and consequently the second input of the AND gate are at low level, so that current $I_s$ is interrupted. Resistors R1 and R2 determine the saturation current of transistors T1 and T2.

DIGITAL INTEGRATOR 15

Figure 15:
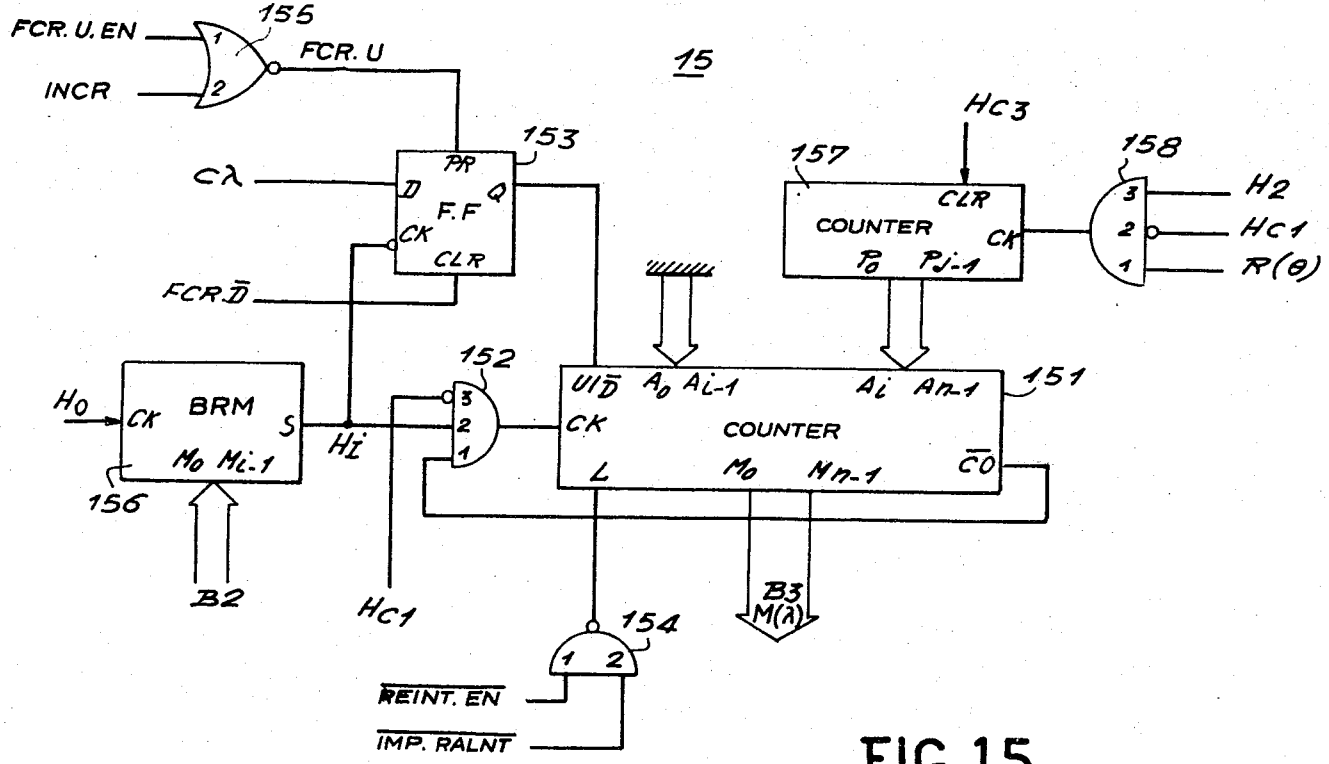
FIG. 15 in the form of a block diagram, an embodiment of the digital integrator.

FIG. 15 shows in the form of a block diagram an embodiment of the digital integrator, which essentially comprises a programmable up/down counter 151. The counter comprises a clock input CK connected to a logic AND gate 152, a U/$\overline{D}$ counting direction input connected to output Q of a flip-flop 153 of the D type, data inputs Ao to An-1, a loading input L for the input and output data connected to a logic AND gate 154 and outputs of state of n flip-flops constituting counter 151. Theses latter outputs are located on bus B3 which supplies the digital data M(λ). The counter also has an overflow output $\overline{CO}$ connected to a first input of gate 152 for blocking the content of counter 151 to the values $2^n-1$ in the down counting direction. The means for varying the integral loop gain as a function of the speed of revolution of the engine comprises a discrete frequency multiplier (156) of e.g. the BRM type. The data inputs $M_o$ to $M_{i-1}$ are connected to bus B2 which supplies digital data representing the speed of revolution of the engine. The clock input CK receives a timing signal $H_O$ supplied by the timing signal generator 14. At its signal output S, the multiplier supplies a timing signal $H_I$ of frequency $DF_I$, which is a function of the engine revolution speed. This timing signal $H_I$ is applied to a second input of gate 152. A third complementary input of said gate receives the timing signal $H_{c1}$ making it possible, on starting an electrovalve cycle to stabilise for a short time the output data of counter 151 in order to permit the transfer thereof to the time duration modulator 16. Flip-flop 153 has a data input D which receives the output signals Cλ from the level comparator 11, a clock input CK controlled by the timing signal $H_I$, two priority control inputs, a preset input PR which receives a signal FCR.U making it possible to force the increase of the counter and a CLR input which receives a signal FCR.$\overline{D}$ making it possible to force the incrementation (up counting) of the counter. The input PR of flip-flop 153 is connected to a logic NOR gate which receives on a first input a signal FCR.U.EN enabling the forcing in the up counting direction and on a second input a signal INCR giving an up-counting command. Gate 154 has a first input which receives a REINT.EN signal enabling the reinitialization of the counter and a second input which receives an UMP.RALNT signal constituting a reinitialization command when the engine leaves the idling condition corresponding to zone I in FIG. 5*b*.

Digital integrator 15 has means for the reinitialization of the content of counter 151 to the value of the cyclic opening ratio of the control signal R(θ) for the electrovalves. This reinitialization means includes the up counter 157 and the logic AND gate 158. The number j of flip-flops in counter 158 can be smaller than the number N of flip-flops in counter 151. In this case, the least significant data inputs $A_o$ to $1_{i-1}$ are polarized to low levels and inputs $A_i$ to $A_{n-1}$ are correspondingly connected to the state outputs $P_o$-$P_{j-1}$ of counter 158, which has a clock input CK connected to logic gate 158 and a clear input CLR which receives the timing signal $H_{c3}$. Logic gate 158 has a first input which receives the output signal R(θ) from the time duration modulator 18, a second complementary input which receives the timing signal $H_{c1}$ and a third input which receives a timing signal $H_2$ of frequency $Fo/2^{n-j}$.

The operation of this digital integrator 15 will be described hereinafter. When signal Cλ is at high level, corresponding to a lean carburetted mixture, the output Q of flip-flop 150 is at high level and the counter 151 counts in the up direction corresponding to an increase in the counter content. However, when signal Cλ is at low level there is a decrease in the counter content. The connection between output $\overline{CO}$ of counter 151 and the first input of gate 152 makes it possible, e.g. in the case of damage to the EGO sensor to stop counter 151 at its maximum value $2^{n-1}$ corresponding to a rich carburetted mixture. The content of counter 157 is reset to zero by timing signal $H_{c3}$, and is then increased during the time interval during which signal $R(\theta)$ is at high level. The content of counter 157 is transferred into counter 151 under the action of the low level signal REINT.EN on the open loop regulating mode or by the low level signal IMP.RALNT when the engine leaves the idling condition.

TIME DURATION MODULATORS 16, 18 and 19

Figure 16A:
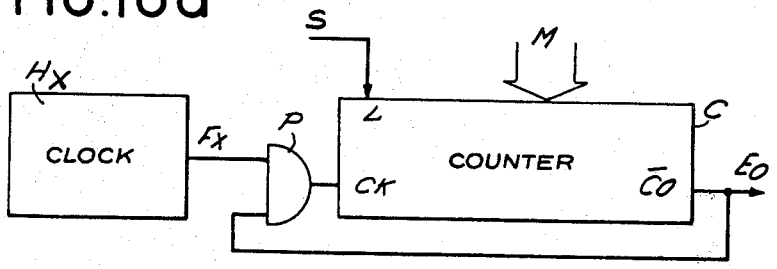
FIG. 16*a* in the form of a block diagram, the basic construction of the time duration modulator.

Before giving a detailed description of the different time duration modulators, whose function is to vary the cyclic opening ratio value of electrovalves EV1 and EV2, reference will be made to FIG. 16*a* which shows the basic structure of a circuit making it possible to modulate the duration or width of a pulse as a function of a digital input variable M available on m bits. Such a circuit essentially comprises, connected in series:

a clock circuit $H_x$ which supplies a timing signal at a fixed or variable frequency $F_x$, a logic AND gate P, a programmable down counter C incorporating m counting stages and having a clock input CK, a loading input L which receives a synchronization signal S, m data inputs receiving the digital data M, an identification output $\overline{CO}$ of the zero content of the counter, the output signal $E_O$ being sampled on said output.

Figure 16B:
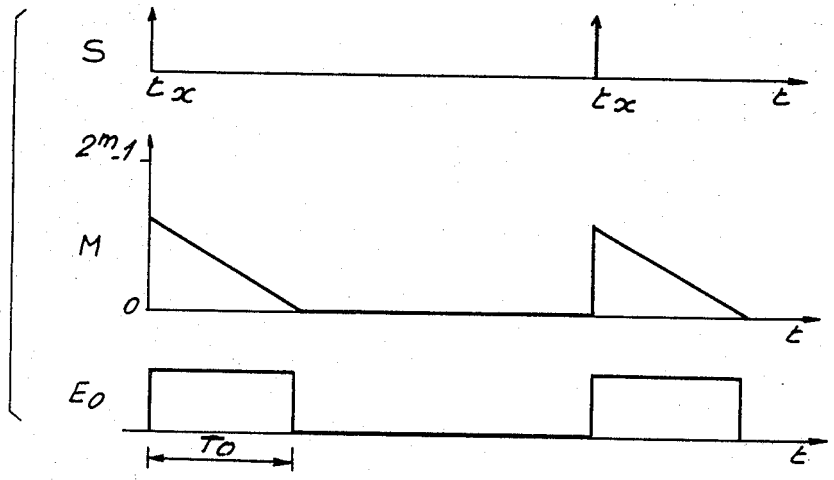
FIG. 16*b* the chronogram of the main signals associated with the time duration modulator of FIG. 16*a*.

FIG. 16*b* is a chronogram of the main signals associated with the circuit of FIG. 16*a* which operates in the following manner. At times $t_x$, the content of counter C is loaded to value M. This content is then reduced at the speed of the timing signal $F_x$ to a zero value. The counter is then kept at this zero value by coupling the output $\overline{CO}$ to one of the inputs of gate P. The pulse duration of output signal $E_o$ is given by the following equation:

$$T_o = M/F_x$$

TIME DURATION MODULATOR 16

During closed loop operation of the controller, time duration modulator 16 makes it possible to vary the cyclic opening ratio of the electrovalves. Modulator 16 is shown in the form of a block diagram in FIG. 17*a*. It essentially comprises two linked digital time duration modulators:

a first time duration modulator comprising a programmable down counter 161 of n bits which receives at its end data inputs $A_o$ or $A_{n-1}$ the digital signal $M(\lambda)$ supplied by the integrator 15 on bus B3 and a logic AND gate 162, a second time duration modulator comprising a programmable down counter 163 of m bits, whose m (m lower than n) data inputs $A_o$ to $A_{n-1}$ are connected to a fixed level digital signal source C and a logic AND gate 164.

The timing signal of the first time duration modulator is the timing signal Ho of frequency Fo, whilst the timing signal of the second modulator is a timing signal $H_i$ of frequency $F_i = F_o/2^{n-m}$ which can be supplied by the timing signal generator 14. It is pointed out in this connection that constant C corresponding to a proportional gain factor does not have to be defined with a precision of n bits.

The output signals $R_1(\lambda)$ and $R_2(\lambda)$ corresponding respectively to the first and second digital modulators are applied to the two inputs of an electronic switch 165, whose control input C receives the output signal $C\lambda$ from the level comparator 11.

Figure 17A:
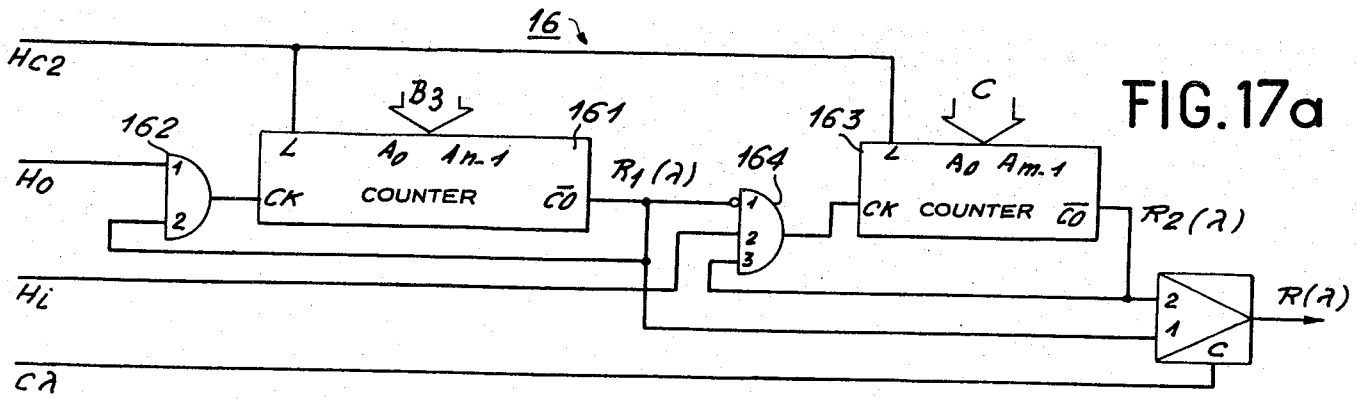
FIG. 17*a* in the form of a block diagram an embodiment of the time duration modulator supplying the signal R(λ)
Figure 17B:
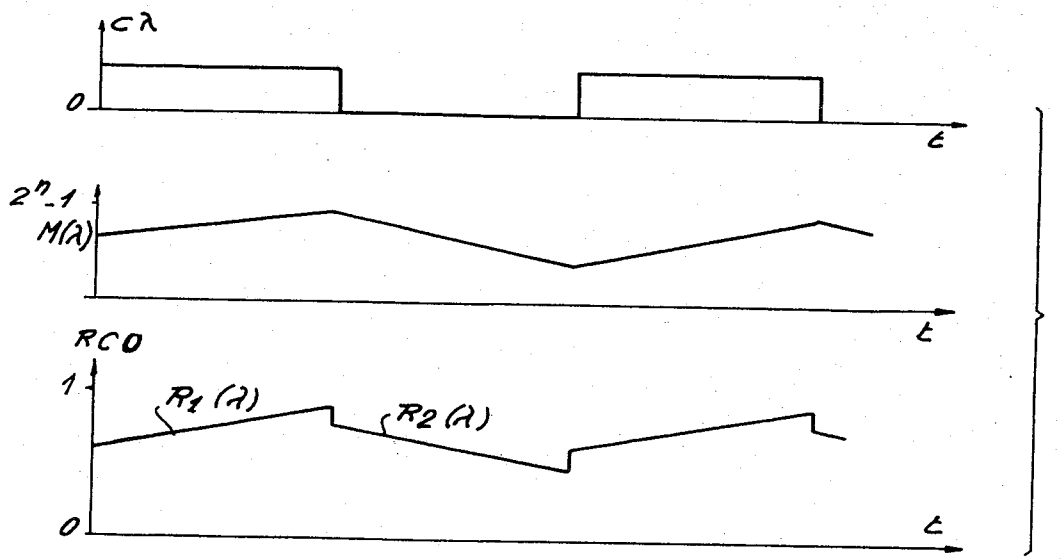
FIG. 17*b* the chronograms of the main signals associated with the modulator of FIG. 17*a*.

FIG. 17*b* shows a chronogram of the main signals associated with the time duration modulator of FIG. 17*a*. Signal $C\lambda$ is shown in an idealised form and in actual fact the period of said signal is not as regular because the latter is supplied by the EGO sensor $\lambda$ which is in fact an error detector. The digital signal $M(\lambda)$ supplied by the digital integrator fluctuates slightly about a mean value, due to the non-linear characteristic of the regulating loop. The cyclic opening ratio value of output signal $R(\lambda)$ is dependent on the level of signal $C\lambda$ $$R_1(\lambda) = \frac{M(\lambda)}{2^{n-1}}$$

$$R_2(\lambda) = \frac{M(\lambda)}{2^{n-1}} + \frac{C}{2^{m-1}}$$

TIME DURATION MODULATOR 18

Figure 18:
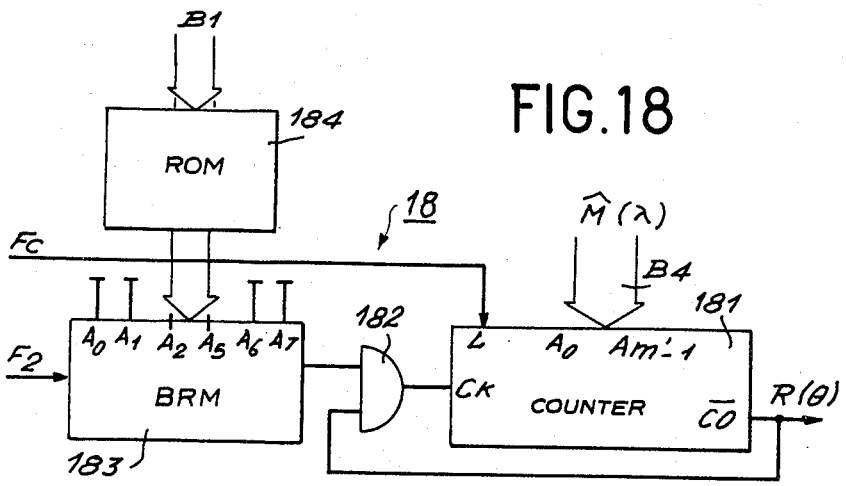
FIG. 18 in the form of a block diagram, an embodiment of the time duration modulator supplying the signal R(θ)

The time duration modulator 18, when the controller is operating on an open loop basis, makes it possible to vary the cyclic opening ratio of the electrovalves as a function of the engine temperature. Modulator 18 is shown in the form of a block diagram in FIG. 18. It comprises a single time duration modulator and an electronic means making it possible to vary the frequency of the timing signal for decreasing the counter content. It is pointed out that the resolution or precision of this modulator does not have to be as high as that of the preceding modulator due to the fact that it is used only during the open loop operation of the controller.

The time duration modulator 18 comprises:

a programmable down counter 181 of m' bits, whose m' data inputs $A_o$ to $A_{m'-1}$ are correspondingly connected to the m' most significant (MSB) data $\bar{M}(\lambda)$ supplied on bus B4 by the digital memory 17, a logic AND gate 182, whose output is connected to the clock input CK of counter 181, a discrete frequency multiplier 183, e.g. of the BRM type incorporating an input which receives a timing signal at a frequency $F2 = F_o/2^{n-m'}$, a temperature programme circuit 184, e.g. a read-only memory (ROM) addressed by the data of bus B1.

The frequency Fx of the output signal of multiplier 183 is given by the following equation:

$$F_x = F2/K$$

with $K = s^P/Nx$ in which Nx is the numerical value of the programming of the data inputs of the multiplier. For reference purposes, p representing the number of bits of the multiplier is equal to 8 with data inputs $A_o$, $A_1$, $A_6$ and $A_7$ positioned at high level and the data inputs $A_2$ to $A_5$ connected to the output of the temperature programme memory 184 coefficient K can be varied between unity and a value equal to 1.3.

It is thus apparent that the cyclic opening ratio value of the electrovalves in open loop is equal to the cyclic opening ratio value in closed loop multiplied by a factor higher than unity and a function of the engine temperature. Consequently, in open loop, the controller acts to bring about an increase in the richness of the air/fuel mixture admitted into the engine cylinders.

TIME DURATION MODULATOR 19

Figure 19:
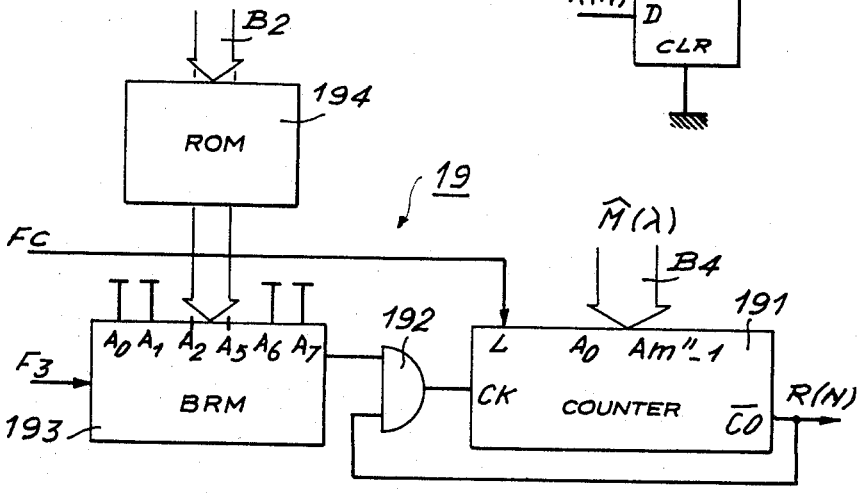
FIG. 19 in the form of a block diagram an embodiment of a time duration modulator supplying the signal R(N).

When the controller is operating in open loop, the time duration modulator 19 makes it possible to vary the cyclic opening ratio of the electrovalves as a function of the engine revolution speed. Modulator 19 is shown in the form of a block diagram in FIG. 19, its structure being identical to that of modulator 18. It comprises the following elements:

a programmable down counter 191 of m' bits, whose m'' data inputs Ao to Am''−1 are connected to m'' most significant bits (MSB) of digital data $\hat{M}(\lambda)$ supplied on bus B4 by digital memory 17, a logic AND gate 192, whose output is connected to the clock input CK of counter 191, a discrete frequency multiplier 193, e.g. of the BRM type having an input which receives a timing signal at a frequency $F_3 = Fo/2^{m-m''}$, a speed programming circuit 194, for example an ROM memory addressed by the data of bus B2.

All the comments made regarding modulator 18 apply here and in particular the choice of the value of parameter m' which imposes the resolution of the modulator and the programming of the BRM inputs.

DIGITAL MEMORY 17

Figure 20A:
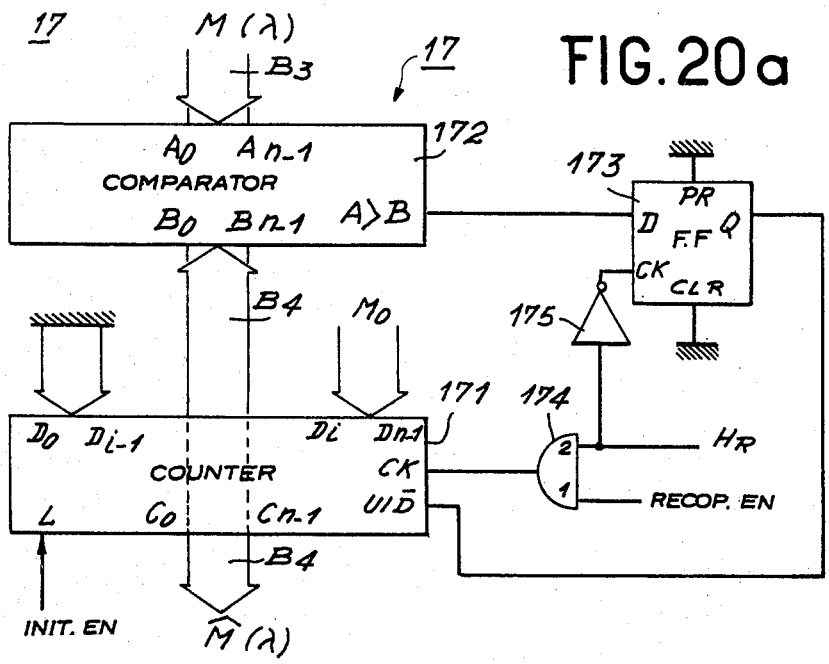
FIG. 20*a* in the form of a block diagram an embodiment of the digital memory.

FIG. 20*a* shows in the form of a block diagram an embodiment of digital memory 17, which comprises the following elements:

a programmable up/down counter having a clock input CK, the U/$\overline{D}$ counting direction input, a loading input L, data inputs Do to Dn−1 and outputs of the states of counting stages Co to Cn−1 which supply on a bus B4 a digital signal $\hat{M}(\lambda)$ which corresponds to the filtered value of output signal M(λ) of digital integrator 15, a digital comparator 172 having first inputs Ao to An−1 correspondingly connected to outputs Mo to Mn−1 of counter 151 of digital integrator 15, second inputs Bo to Bn−1 correspondingly connected to outputs Co to Cn−1 of counter 171 and a comparison output indicating whether the magnitude of signal M(λ) exceeds the magnitude of signal $\hat{M}(\lambda)$, increase/decrease means for counter 151 including a flip-flop 173 of the D type in which input D is connected to the comparison output of comparator 172, output Q is connected to the U/$\overline{D}$ counting direction input of counter 171 and an AND gate 174, whose output is connected to the clock input CK of counter 171.

The recording speed of this digital memory 15 is determined by the frequency $F_R$ of a recording timing signal $H_R$. The recording of signal M(λ) by this digital memory 15 is enabled by a high level RECOP.EN signal supplied by logic circuit 23 and applied to a first input of gate 174. The frequency $F_R$ of the recording timing signal $H_R$ can be equal to the cycle frequency $F_c$ of the electrovalves or to a multiple of this frequency, as a function of the desired recording speed. This signal $H_R$ is applied to a second input of gate 174 and across an inverter 175 to the clock input CK of flip-flop 173.

When the controller 6 is first put into operation, it is necessary to initialize the content of counter 171. To this end, a digital voltage source of value Mo is connected to most significant data input $D_i$ to $D_{n-1}$ and the least significant data inputs $D_o$ to $D_{i-1}$ are connected to a low level. This digital voltage supply can be constituted by a digital potentiometer supplied by the voltage supply $V_{cc}$. The loading of the digital magnitude Mo into counter 171 is carried out under the effect of an initialization enabling signal INIT.EN applied to the loading input L of the said counter.

Figure 20B:
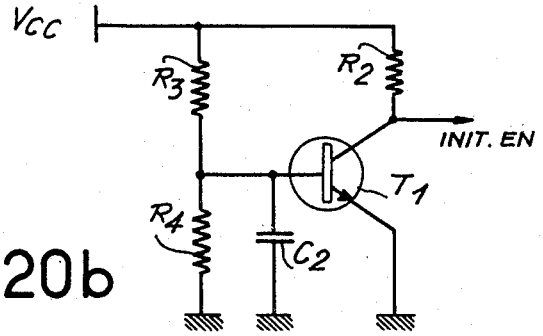
FIG. 20*b* in the form of an electrical diagram, an embodiment of the circuit supplying the signal INIT-.EN enabling the initialization of the digital memory.

FIG. 20*b* shows in the form of an electric diagram an embodiment of a circuit making it possible to process the INIT.EN signal enabling the initialization of counter 171. This circuit essentially comprises an NPN transistor T1 energised from the stabilised d.c. voltage Vcc supplied by the power supply circuit 27. The base of transistor T1 is connected to voltage Vcc across a delay circuit including resistors R3, R4 and capacitor C2. When D.C voltage $V_{cc}$ appears, the voltage at the junction point of resistor R2 and the collector is at high level for a fraction of a second due to the delay network in series with the base of the transistor. This has the effect of enabling the change of magnitude Mo in counter 171.

The digital memory 17 is continuously supplied by supply voltage Vcc. After a first start-up of the engine, the content of this memory is magnitude $\hat{M}(\lambda)$. However, in the case of an accidental interruption in the power supply Vcc the digital memory can again be initialized to the value Mo.

The digital memory as described hereinbefore has a storage capacity of n bits and is equal to that of digital integrator 15. This condition is not absolutely necessary, the storage capacity of said digital memory being essentially determined by the number of bits m' or m'' of the time duration modulators 18 and 19. In order to have the maximum operating dynamics of the controller, the initial setting of the carburettor must be such that the value of the digital source Mo is equal to $2^{n-1}$. In this case, the data inputs Do to $D_{n-2}$ are polarized at low level and the data input $D_{n-1}$ to high level.

ADDITIONAL CIRCUITS an upper limit circuit of signal R(λ), a lower limit circuit of signal R(λ), a circuit making it possible to render asymmetrical the digital integrator gain in accordance with the sign of signal Cλ, a circuit making it possible to introduce delay making the mixture leaner.

UPPER LIMIT CIRCUIT

Figure 21:
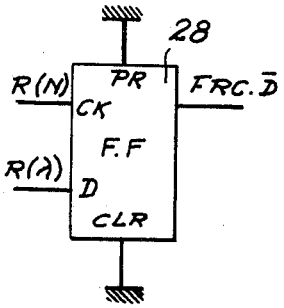
FIG. 21 A block diagram of an embodiment of the upper limit circuit.

FIG. 21 shows in the form of a block diagram an embodiment of an upper limit circuit for the signal R(λ) for the closed loop regulation of electrovalves EV1 and EV2. This circuit essentially comprises a flip-flop 28 of the D type in which the output signal R(λ) of the high modulator 16 is applied to the input D, the output signal R(N) of time modulator 19 is applied to the clock input CK and the output signal ERC.$\overline{D}$ is sampled at output Q.

Signal R(λ) is sampled by signal R(N). When the duration of signal R(λ) exceeds the duration of signal R(N) output signal FRC.$\overline{D}$ is at high level. This signal is connected to the CLR input of flip-flop 153. As a result, the content of counter 151 of digital integrator 15 is reduced.

LOWER LIMIT CIRCUIT

Figure 22:
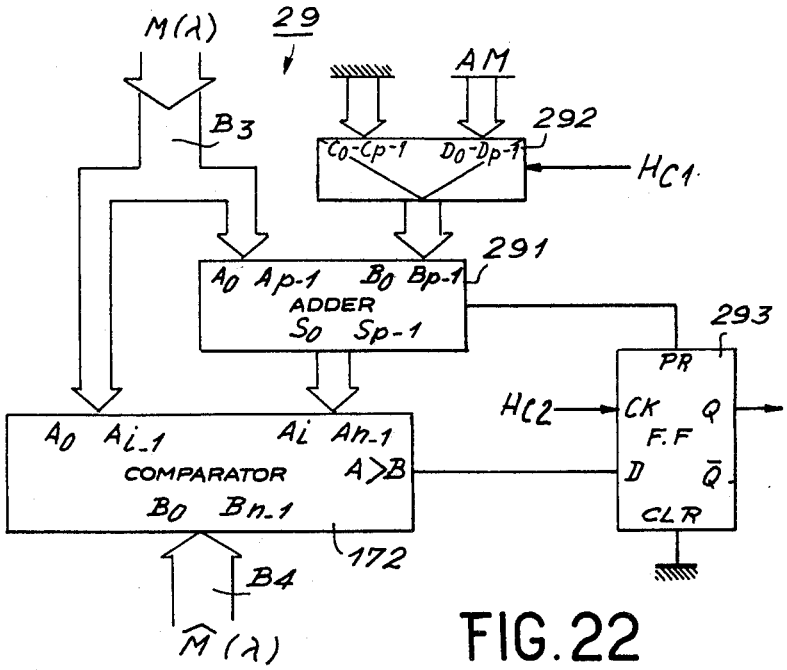
FIG. 22 a block diagram of an embodiment of the lower limit circuit.

FIG. 22 shows in the form of a block diagram an embodiment of a lower limit circuit 29 for the signal R(λ) for the closed loop regulation of electro-valves EV1 and EV2.

For certain engine temperature ranges, particularly that corresponding to zone B defined hereinbefore, the cyclic opening ratio of the regulating signal R(λ) must not be below a quantity $[\hat{M}(\lambda)-\Delta M]/2^{n-1}$, ΔM being a given fixed magnitude. For this purpose, an adder 291 is provided between the most significant outputs of digital integrator 15 and the most significant inputs of comparator 172 of digital memory 17. This adder 291 has first inputs Ao-Ap−1 correspondingly connected to the most significant bits of bus B3 and second inputs Bo-Bp−1 connected to the output of a multiplexer 292 controlled by the timing signal Hc1. The first inputs Co-Cp−1 of this multiplexer are connected to low level, whilst the second inputs Do-Dp−1 are connected to the digital magnitude ΔM. For a short time, corresponding to the duration of timing signal $H_{c1}$, the digital magnitude ΔM is transferred to the inputs Bo-Bp−1 of adder 291 and summated with magnitude M(λ). The comparison output of digital comparator 172 is sampled by a type D flip-flop 293 which receives at its clock input CK the timing signal $H_{c2}$. The output signal INCR sampled at the output Q of flip-flop 293 indicates the sign of the deviation. When the cyclic opening ratio value of signal R(λ) or M(λ) is below the value $[\hat{M}(\lambda)-\Delta M]$ and when the engine temperature corresponds to zone B, counter 151 is forced in the up direction.

EGO SENSOR CHARACTERISTIC SHIFT CIRCUITS

The output signal characteristic (FIG. 3*a*) of the air/fuel ratio of a lambda detector is abrupt and is substantially centered on the stoichiometric ratio (λ=1). The stoichiometric ratio does not always correspond to the optimum closed loop operating point of the controller, for example it is sometimes desirable to shift the regulating point towards lean carburetted mixtures in order to reduce the specific fuel consumption or the carbon monoxide and hydrocarbon quantities emitted. This shift can be obtained by two known processes. The first process consists of making the integral loop gain asymmetrical and the second consists of delaying the order to make the mixture leaner.

ASYMMETRY CIRCUIT

Figure 23:
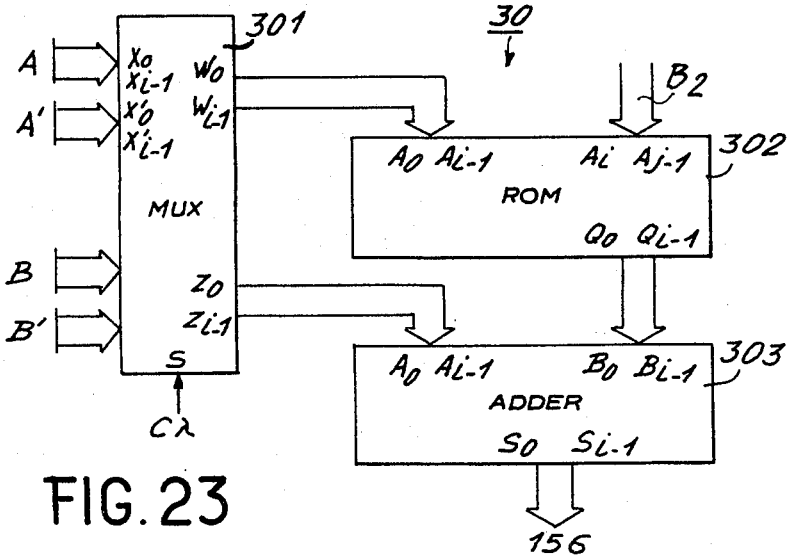
FIG. 23 a block diagram of an embodiment of the asymmetry circuit of the loop.

FIG. 23 shows in the form of a block diagram an embodiment of a circuit 30 making it possible to carry out an asymmetrical loop gain control. This circuit 30 can be inserted in bus B2 between analog/digital converter 13 and digital integrator 15. It is pointed out that the integral control gain is proportional to the frequency of the timing signal for increasing the count 151 of digital integrator 15 and by modifying the magnitude of the digital programming data of BRM multiplier 156.

Circuit 30 comprises the following elements: A double multiplexer 301, whose control input S is connected to the output of level comparator 11 which supplies the signal Cλ. This multiplexer has two groups of inputs, namely a first group Xo-$X_{i-1}$ and X'o-$X'_{i-1}$ programmed respectively by the digital or numerical values A and A' and a second group of inputs Yo-$Y_{i-1}$ and $Y'_o$-$Y'_{i-1}$ programmed respectively by the numerical or digital values B and B'. The magnitude of the factors A-A' and B-B'' is predetermined. This multiplexer has two outputs $W_o$-$W_{i-1}$ and $Z_o$-$Z_{i-1}$.

A read-only memory (ROM) 302 having j inputs for addressing to read $A_o$-$A_{j-1}$. Inputs $A_o$-$A_{i-1}$ are correspondingly connected to outputs $W_o$-$W_{i-1}$ of multiplexer 301 and inputs $A_u$-$A_{j-1}$ are correspondingly connected to bus B2, which transmits digital data representing the engine revolution speed, as indicated hereinbefore.

A numerical adder 303 which has first inputs $A_o$-$A_{i-1}$ correspondingly connected to the outputs $Z_o$-$Z_{i-1}$ of multiplexer 301 and second inputs Bo-Bi−1 correspondingly connected to outputs $Q_o$-$Q_{i-1}$ of the ROM, the outputs $S_o$-$S_{i-1}$ of this adder are correspondingly connected to the inputs $M_o$-$M_{i-1}$ of BRM multiplier 156 of digital integrator 15.

This asymmetry circuit operates as follows. By alternating programming under the control of signal Cλ, ROM 302 forms the product of the speed of revolution N of the engine by constants A and A'. Adder 303 fixes the origin of products AN and A'N.

By the choice of the value of A-A' and B-B', the aforementioned asymmetry circuit makes it possible to modify the integral loop gain. However, in practice, a single value of these parameters can be determined, whilst the asymmetry circuit can be simplified and have only ROM 302 addressed on the one hand by bus B'' and on the other by signal Cλ.

CIRCUIT 31 FOR DELAYING THE LEANESS OF THE MIXTURE

Figure 24:
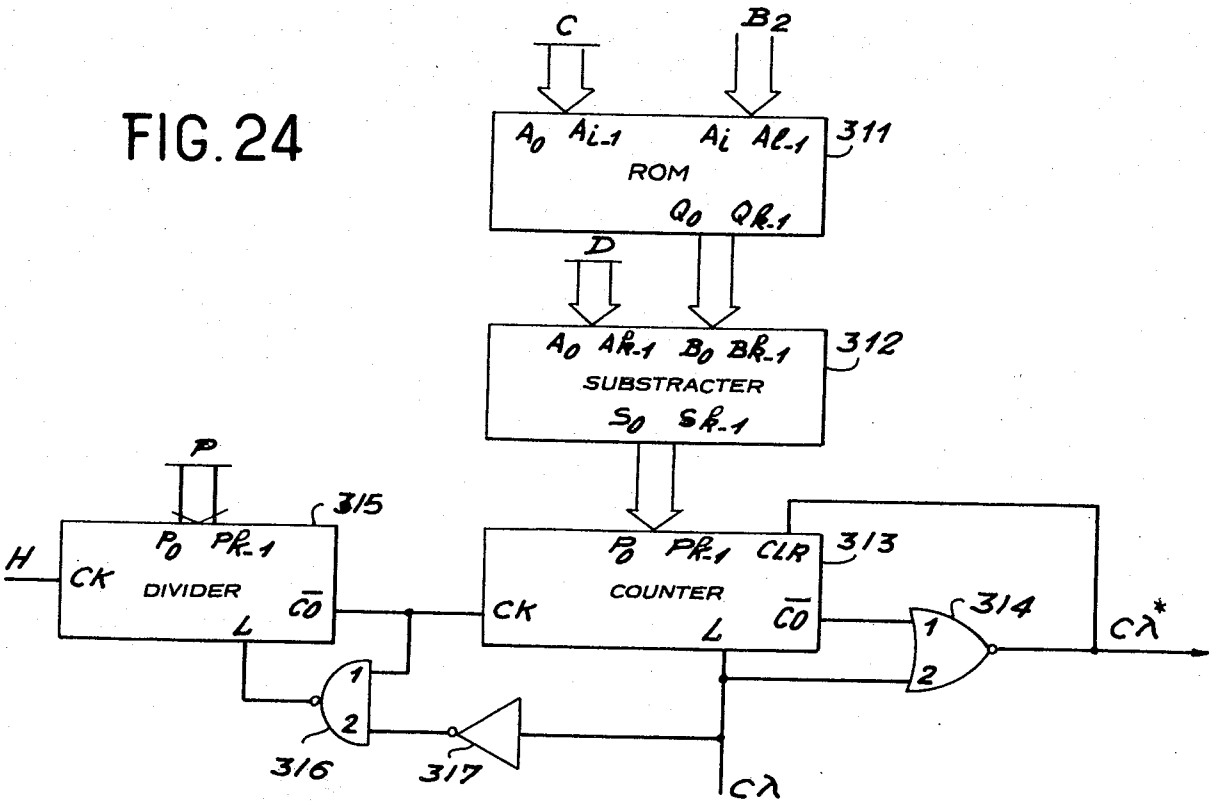
FIG. 24 a block diagram of an embodiment of the delay circuit for making the mixture leaner.

FIG. 24 shows in the form of a block diagram an embodiment of a circuit 31 making it possible to delay the leaness of the mixture. This delay varies in linear manner in the range of engine revolution speeds between the already defined values Ni and Ns. On either side of said speed range, the leaness delay remains constant. To this end, circuit 31 comprises the following elements:

A read-only memory (ROM) 311, which has the following read addressing inputs. Inputs $A_o$-$A_{i-1}$ are connected to a digital source of fixed magnitude and outputs $A_i$-$A_{f-1}$ are correspondingly connected to bus B2 which carries the digital data concerning the speed of revolution N of the engine.

A digital subtracter 312 having first inputs $A_o$-$A_{k-1}$ connected to a digital source of fixed magnitude D and second inputs $B_o$-$B_{k-1}$ correspondingly connected to the outputs $Q_o$-$Q_{k-1}$ of ROM.

A programmable down counter 313 having programming inputs $P_o$-$P_{k-1}$ correspondingly connected to the outputs $S_o$-$S_{k-1}$ of the subtracter. An output $\overline{CO}$ indicates that the content of the said counter has a zero value. There is also a loading input L connected to the output of level comparator 11, a zeroing input CLR, the output $\overline{CO}$ and the output of level comparator 11 being respectively connected to first and second inputs of a logic NOR gate 314. The output of the gate is connected to the inputs CLR of counter 313, whilst the latter also has a clock input CK.

A programmable frequency divider 315 which has a clock input CK receiving a timing signal H and an output $\overline{CO}$ connected to the clock input of counter 313. It also has programming inputs $P_o$-$P_{k-1}$ connected to a digital source of fixed magnitude P, a loading input L connected to a logic NAND gate 316, a first input of said gate being connected to the output $\overline{CO}$ and a second input being connected via an inverter 317 to the output of voltage comparator 11.

The output signal Cλ* is sampled at the output of gate 314. The circuit 31 operates in the following manner. The ROM memory 311 or programme memory supplies the delay gradient on leaness the mixture as a function of the speed of revolution N of the engine. Subtracter 312 makes it possible to bring about an initial leaness delay, whilst counter 315 regulates the delay introduced by counter 313.

The advantages provided by the electronic carburettion controller according to the invention are now more apparent. The regulating values of the flow rate of the fluids obtained during closed loop operation can be retained and used during open loop operation. The regulating values for the flow rate of the fluids during open loop operation are deduced from the closed loop values by a multiplicatory factor which is a function of the value of an engine operating parameter. When the vehicle is non operating, the controller consumes a very small amount of electric power. However, the electric power supply of the controller can be interrupted during stoppage, the controller having internal re-initialization means.

The invention is applicable to internal combustion engines equipped with a carburettor or a fuel injection system.

What is claimed is:

1. A digital electronic controller for regulating the air/fuel ratio of the mixture supplied to the cylinders of an internal combustion engine, having an EGO sensor situated on the exhaust path of the burned gases, at least one fuel supply device, such as a carburetor, whose fuel flow rate can be modified by an electrovalve controlled on the basis of an opening/closing cycle and a plurality of sensors for measuring operating conditions of this engine, said electronic controller comprising:

a clock signal generator providing synchronous signals and a clock signal at the electrovalve cycle frequency;

a closed loop digital circuit of the proportional integral type with variable gain, said closed loop being connected between said EGO sensor and said electrovalve and including a digital integrator having a gain control input receiving a digital signal representative of the rotation speed of the motor, a digital time duration modulator having a control input connected to the EGO sensor, and a multiplexer for opening said closed loop, said multiplexer having a command input connected to a logic circuit sensitive to operating conditions of said motor and at least a second input receiving a command signal sensitive to a motor physical parameter such as the temperature or the rotation speed of the motor.

2. The controller according to claim 1, wherein said digital integrator comprise a programmable counter of the up/down type, whose clock input is connected to a binary rate multiplier programmed by a digital signal representing the speed of revolution of the engine, said binary rate multiplier having a clock input connected to the said clock signal generator and data input connected respectively to the output of an A/D convertor which receives an analog signal representative of the speed of revolution of the engine.

3. The controller according to claim 2, wherein said programmable counter has an overflow output connected to a first input of a logic gate whose second input is connected to said binary rate multiplier and whose output is connected to the clock input of the said counter.

4. The controller according to claim 3, wherein the counting direction input of said programmable counter is connected to a counting direction selection circuit including means for forcing the counting direction.

5. The controller according to claim 1, wherein said time duration modulator comprises two linked programmable counters, each of the counters being loop connected with the first counter of said two counters having data inputs connected respectively to outputs of the digital integrator and the second counter of said two counters having data inputs connected respectively to a digital voltage source, and wherein the outputs of said two counters are connected to a multiplexer controlled by the output signal of said EGO sensor.

6. The controller according to claim 1, wherein the output signal of said digital integrator is stored in a digital memory circuit comprising, loop connected, a programmable counter of the up/down type and a digital comparator, said comparator having first data inputs connected respectively to outputs of said programmable counter whose data inputs are connected to a digital voltage source and the loading input receives an initialization command signal.

7. The controller according to claim 6, further comprising a second time duration modulator connected between said digital memory circuit and the second input of said multiplexer, said second time duration modulator comprising a programmable counter, loop connected, whose data inputs are connected respectively to outputs of said digital memory circuit, the loading input is connected to the clock signal at the frequency of the cycle of said electrovalve and the clock input is connected to a binary rate multiplier whose data inputs receive a digital signal representative of the temperature of the engine and the clock input is connected to said clock signal generator.

8. The controller according to any one of claims 1 to 7 further comprising a time duration comparator which is connected between the output of the first time duration modulator and the output of the second time duration modulator for providing an output signal to the counting direction forcing means.

9. The controller according to any one of claims 1 to 7, wherein each of said circuits are constructed in accordance with C-MOS technology and wherein the clock signals are interrupted when the engine is not operating.

10. An internal combustion engine, comprising a digital electronic controller according to any one of the claims 1 to 7.

* * * * *